US006609526B2

(12) United States Patent
Yuhara

(10) Patent No.: US 6,609,526 B2
(45) Date of Patent: Aug. 26, 2003

(54) NETTED REFILLABLE CONTAINER FOR POWDERY COSMETIC MATERIAL

(75) Inventor: Yukitomo Yuhara, Tokyo (JP)

(73) Assignee: Yoshida Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/055,355

(22) Filed: Jan. 25, 2002

(65) Prior Publication Data

US 2003/0140936 A1 Jul. 31, 2003

(51) Int. Cl.[7] ..... A45D 33/02
(52) U.S. Cl. ..... 132/307
(58) Field of Search ..... 132/307, 306, 132/293, 294, 298, 300, 301, 305, 314, 315, 316; 206/581, 823, 235, 37, 1.5; 220/836

(56) References Cited

U.S. PATENT DOCUMENTS

| | | | | | |
|---|---|---|---|---|---|
| 1,911,691 A | * | 5/1933 | Jacobson | ..... | 132/293 |
| 4,557,620 A | * | 12/1985 | Hancy | ..... | 401/200 |
| 5,865,194 A | * | 2/1999 | Gueret | ..... | 132/299 |
| 5,896,866 A | * | 4/1999 | Quennessen | ..... | 132/293 |
| 5,908,037 A | * | 6/1999 | Pierson | ..... | 132/293 |

* cited by examiner

*Primary Examiner*—John J. Wilson
*Assistant Examiner*—Robyn Kieu Doan
(74) *Attorney, Agent, or Firm*—Birch, Stewart, Kolasch & Birch, LLP

(57) ABSTRACT

A netted refillable container comprising: a container body molded of a flexible synthetic resin material for containing a powdery cosmetic material therein, the container body having: a substantially flat bottom panel; a side panel extending upright from the bottom panel, the side panel curving outward or inward; an opening surrounded by the side panel; and a ring molded as a united body from a rigid synthetic resin surrounding the opening bearing a convex rib on the top end of the ring, and a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body; and when the container body is contained in a recess of an outer container having the recess of a prescribed depth and a projection on the bottom panel, the bottom panel of the container body faces the projection, and when a lid openably attached to the outer container in bearing a packing facing the convex rib of the container body is closed, the convex rib of the container body presses against the packing through the netting of the net frame.

3 Claims, 15 Drawing Sheets

NETTED REFILLABLE CONTAINER FOR POWDERY COSMETIC MATERIAL

BACKGROUND OF THE INVENTION

1. Field of the Invention

This invention relates to a netted refillable container for containing a powdery cosmetic material and, more particularly, a netted refillable container for preventing solidification of the contained powdery cosmetic material, and also for preventing spillage of the powdery cosmetic material when not in use.

2. Description of Prior Art

Powdery cosmetic materials, e.g., foundations, white powder, or the like are typically contained in a dish-shaped refillable container having an opening formed at the top of the refillable container covered with a netting. This refillable container serves as a cosmetic compact case with an outer container attached with an openable lid. The netting prevents the contained powdery cosmetic material from scattering, and also helps provide the suitable amount of powdery cosmetic material when a cosmetic tool, e.g., powder puff is rubbed against the meshes of the netting.

In respect of the refillable container, since the powdery container material is pressed toward the bottom surface by a net or a cosmetic tool whenever in use, the powdery container material gradually solidifies and becomes difficult for the powdery container material to stick suitably as well as uniformly to a cosmetic tool, e.g., powder puff when in use. Therefore raising a problem in which the disposal of the refillable container and the powdery cosmetic material becomes unavoidable even if there still is powdery cosmetic material remaining inside the refillable container.

To solve the above problem, a refillable container has been proposed in which the container body of the refillable container of a flexible synthetic resin material is molded with a projection either on the outer surface of the bottom panel of the container body or on the inner surface of the bottom panel of the outer container containing the container body. With the thus structured refillable container, when the container body is moved toward the bottom panel of the outer container due to force created when a cosmetic tool is pressed against the netting provided at the upper portion of the container body, one of the provided projections makes contact to the opposing surface and restricts movement of the container body, thereby deforming the container body and the side panel of the container body which correspond to the periphery of the projections. According to the above deformation, the contained powdery cosmetic material is fluidized which helps prevent the solidification of the powdery cosmetic material and also enables the refillable container to be thoroughly used without much waste.

With such a conventional refillable container, the container body deforms either where the projection provided on the bottom panel of the container body of the refillable container makes contact to the bottom panel of the outer container or where the projection provided on the outer container makes contact to the bottom panel of the container body. That is, in respect of the bottom panel of the container body, the portion corresponding to the projection maintains flatness, while the bottom panel surrounding the projection deforms. Therefore, the contained powdery cosmetic material is fluidized mainly by the deformation of the side panel rather than the entire deformation of bottom panel of the container body. Nevertheless, to make the container body effectively increase the fluidization of the contained powdery cosmetic material, it is preferable to widen the area of deformation in respect of the bottom panel.

Te refillable container thus structured is shown in FIG. 15. This refillable container 51 is used in a state in which the refillable container 51 is contained inside a cosmetic compact case 54 having a lid 54*a* and a housing 54*b*. This refillable container 51 is comprised of a container body 52 for containing a powdery cosmetic material 55 and a net frame 53 made up of an engagement loop 53*a* covered by a sheet-like netting 53*b*. The container body 52 is a shallow dish-shaped container molded from a flexible synthetic resin, and has a gentle tapered peripheral sidewall 52*b* in between a bottom portion 52*a* and an opening rim 52*c*.

The engagement loop 53*a* of the net frame 53 is an annular body having the diameter substantially equal to that of the opening rim 52*c* of the container body 52. The sidewall of the engagement loop 53*a* extends along the surface of the opening rim 52*c* and is fitted into the opening rim 52*c* of container body 52. When the engagement loop 53*a* is injection molded, the netting 53*b* is insert-molded and secured to the engagement loop 53*a* as a united body, and at the same time, the top surface of the netting 53*b* becomes the equal level as the top surface of the engagement loop 53*a*. Accordingly, the annular attachment component 53*c* comprised of the engagement loop 53*a* and the netting 53*b* is made into a flat state having no level difference.

The above cosmetic compact case 54 containing the netted refillable container 51 is assembled having a lid 54*a* and a housing 54*b*. That is, both the lid 54*a* and the housing 54*b* have a hinge 54*c* on one end and an engagement projection 54*d* on the other. By rotatably connecting the lid 54*a* to the housing 54*b* through the use of the hinge member 54*c* and by enabling the engagement projections 54*d* to attach to and detach from each other, the cosmetic compact case 54 can be closed and maintain a closed state and can be used in an open state as well.

An engagement ring 54*e* is formed on the inner peripheral surface of the housing 54*b* of the cosmetic compact case 54 and by the engaging of the engagement ring 54*e* to an engagement projection 53*d* formed on the outer peripheral surface of the engagement loop 53*a* attached to the upper portion of the container body 52 of the refillable container 51, the refillable container 51 is attached to the cosmetic compact case 54. There is an elastic packing 56 attached to the inner surface of a lid 54*a* of the cosmetic compact case 54, and the packing 56 fits tightly to the netting 53*b* enabling the prevention of spillage of the powdery cosmetic material 55 when the lid 54*a* is closed.

With thus conventional refillable container, when the lid of the cosmetic compact case is closed and engaged to the housing, the packing pressing against the entire surface of the netting ensures a hermetic state. However, in order to guarantee the hermetic state, it is required for the opening rim of the container body and the engagement loop of the net frame to maintain a molding precision to a certain standard. Therefore, where the components above suffer from bending or deformation and are unable to obtain their intended molding precision, it causes the deterioration of the hermetic state If the only objective was to intensify the hermetic state, it can be accomplished by protuberating the outer peripheral portion in a ring-like shape higher than the netting at the top surface of the engagement loop of the net frame and by making the outer peripheral portion press against the packing. Furthermore, by forming such projection, it would become unnecessary to maintain a high molding precision.

Nevertheless, with this structure, a space will be created between the netting and the packing, which would result to the problem of accumulation of the powdery cosmetic material in the space, for example, due to vibration caused when the cosmetic compact case is carried.

Furthermore, when the netting is insert-molded to the engagement loop, the netting could hardly maintain a sufficiently stretched out state where exerted with a tension perpendicular to the netting, and a slight looseness of the netting would often be created. When such looseness is created, a space may form between the packing and the netting, and would raise a problem of accumulation of the powdery cosmetic material in this space.

It is an object of this invention to provide a netted refillable container which prevents solidification of powdery cosmetic materials by widely deforming the bottom panel of the container body, and also prevents the spillage of powdery cosmetic materials without requiring a high molding precision.

It is another object of this invention to provide a netted refillable container which prevents solidification of powdery cosmetic materials by widely deforming the bottom panel of the container body, and also prevents the spillage of powdery cosmetic materials without requiring a high molding precision.

SUMMARY OF THE INVENTION

The foregoing object is accomplished with a netted refillable container including a container body molded from a flexible synthetic resin material for containing a powdery cosmetic material having a substantially flat bottom panel, a side panel extending upright from the bottom panel, the side panel curving outward or inward, an opening surrounded by the side panel, a ring molded as a united body from a rigid synthetic resin surrounding the opening bearing a convex rib on the top end of the ring, a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body, and when the container body is contained in a recess of an outer container having the recess of a prescribed depth and a projection on the bottom panel, the bottom panel of the container body faces the projection, and when a lid bearing a packing facing the convex rib of the container body is closed, the convex rib of the container body presses against the packing through the netting of the net frame, and the lid is openably and closably attached to the outer container.

The foregoing objective can also be accomplished with a netted refillable container including a container body molded from a flexible synthetic resin material for containing a powdery cosmetic material having, a bottom panel having a substantially flat inner surface and an outer surface provided with a projection at a prescribed position, a side panel extending upright from the bottom panel, the side panel curving outward or inward, an opening surrounded by the side panel, a ring molded as a united body from a rigid synthetic resin surrounding the opening bearing a convex rib on the top end of the ring, a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body, and when the container body is contained in a recess of an outer container having the recess of a prescribed depth and a bottom panel, the projection provided at the outer surface of the bottom panel of the container body faces the bottom panel of an outer container, and when a lid bearing a packing facing the convex rib of the container body is closed, the convex rib of the container body presses against the packing through the netting of the net frame, and the lid is openably and closably attached to the outer container.

In another aspect of the invention for solving the above problem, a netted refillable container comprising a container body molded from a flexible synthetic resin material for containing a powdery cosmetic material having a bottom panel having a corrugated cross-section, a side panel extending upright from the bottom panel, the side panel curving outward or inward, an opening surrounded by the side panel, a ring molded as a united body from a rigid synthetic resin surrounding the opening bearing a convex rib on the top end of the ring, a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body; and when the container body is contained in a recess of an outer container having the recess of a prescribed depth and a projection on the bottom panel, the corrugated bottom panel of the container body faces the projection, and when a lid bearing a packing facing the convex rib of the container body is closed, the convex rib of the container body presses against the packing through the netting of the net frame, and the lid is openably and closably attached to the outer container.

In respect of the foregoing netted refillable container (hereinafter simply referred to as "refillable container"), by molding in to a united body the surrounding of the flexible opening of the container body into a ring formed from a rigid synthetic resin, in which the ring bears a convex shaped rib on the top end, and by engaging a net frame to the container body in a state where a netting of the net frame covers the opening and engages to the rib, a tension works upon the netting in correspondence to the height of the rib, and enables the netting to stretch along the inner surface of the frame body in a sufficiently high-strung manner. Therefore, even if there is to be a looseness created when the net frame is molded, the looseness can be eliminated.

When the net frame is engaged to the container body, the rib causes the netting to project upwards from the opening of the container body. Therefore, when the container body is contained in the outer container, the netting projects to a position closest to the lid, and when the lid is closed, the packing attached to the inner surface of the lid contacts to the facing rib and also to the netting wherein the vertical position of the netting is maintained by the rib; in consequence, a hermetically sealed state is created without having any space between the packing and the netting. Therefore, the spillage of powdery cosmetic material (partially pasty cosmetic material included, hereinafter referring to the same) can be prevented.

When the lid is opened and a cosmetic tool, e.g., powder puff, sponge is rubbed against the netting, a downward force, that is, a pressing force toward the direction of the bottom panel of the outer container works upon the container body. Due to this pressing force, the bottom panel of the container body makes contact to the convex portion provided at the bottom panel of the container body to deform the container body. According to this deformation the powdery cosmetic material becomes fluidized. In other words, whenever in use, the powdery cosmetic material contained in the container body becomes fluidized and does not solidify.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

First Embodiment

Figure 1:
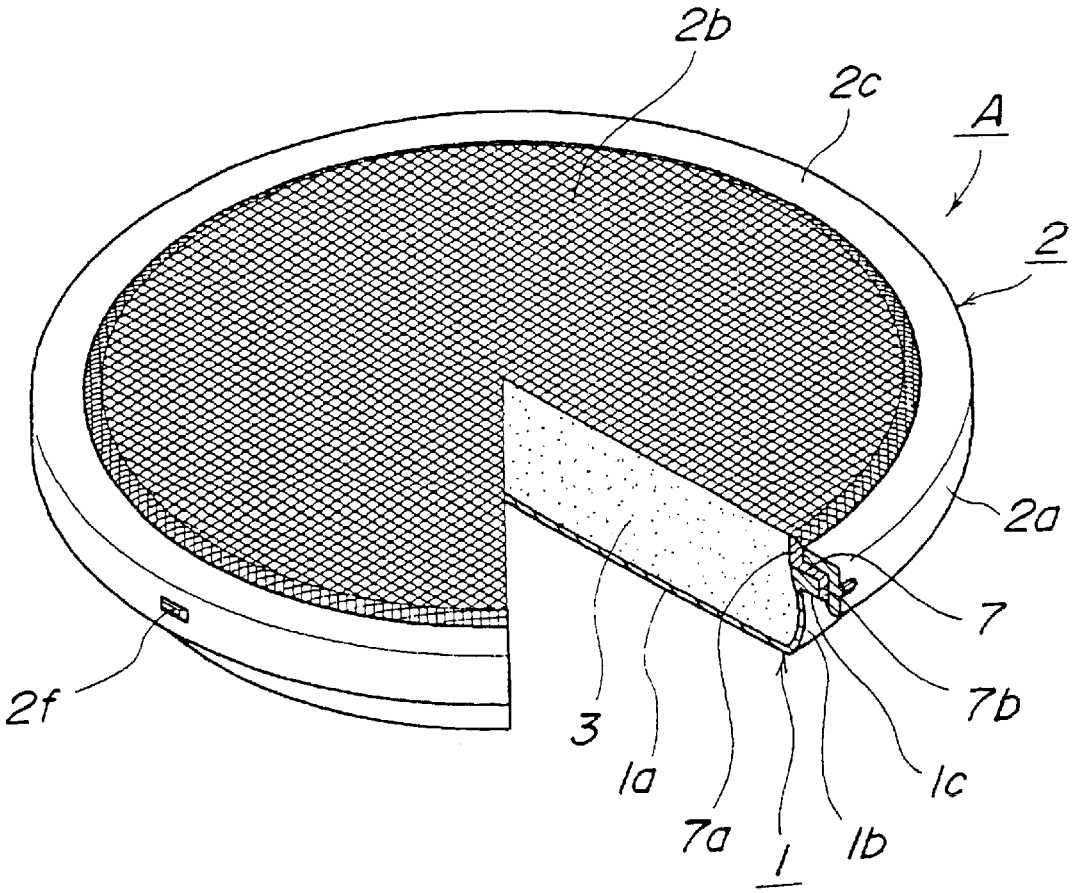
FIG. 1 is a perspective view showing a refillable container, partially dissected, according to the first embodiment of the invention.
Figure 2A:
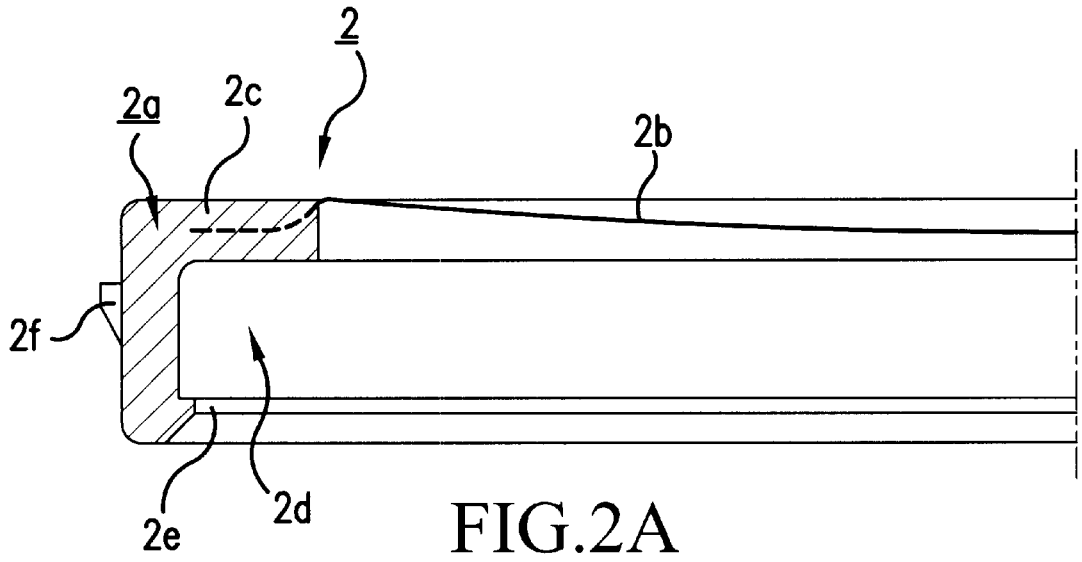
FIGS. 2*a* and 2*b* are enlarged cross section views showing a container body and a net frame of a refillable container, according to the first embodiment of the invention.
Figure 2B:
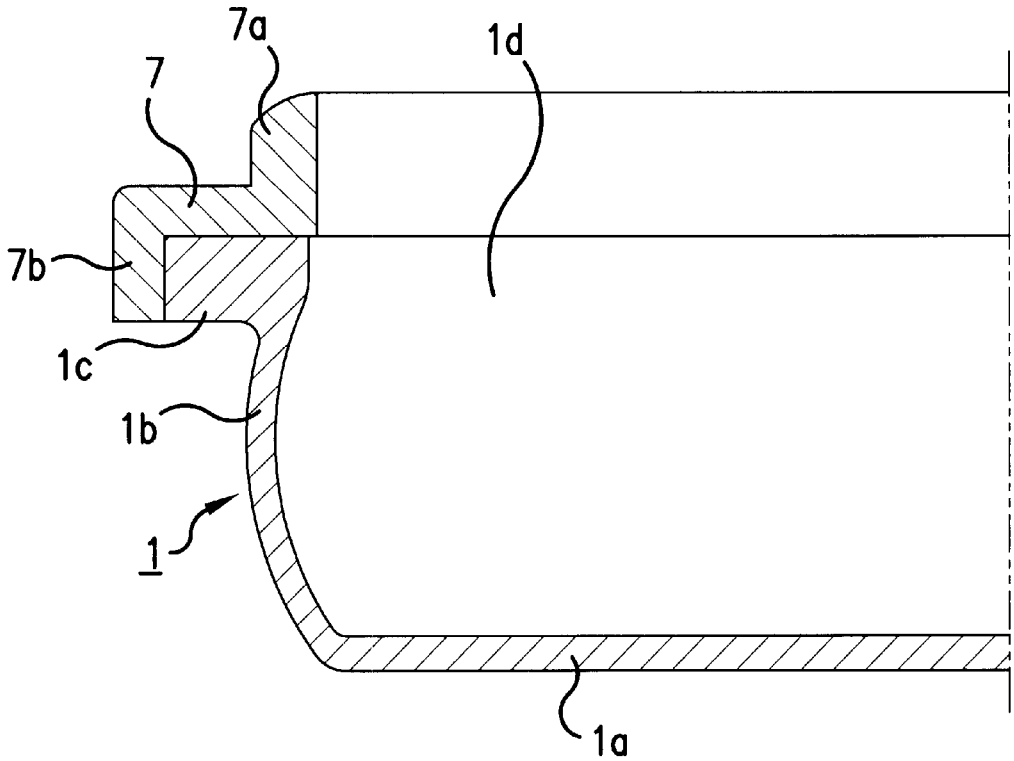
Figure 3:
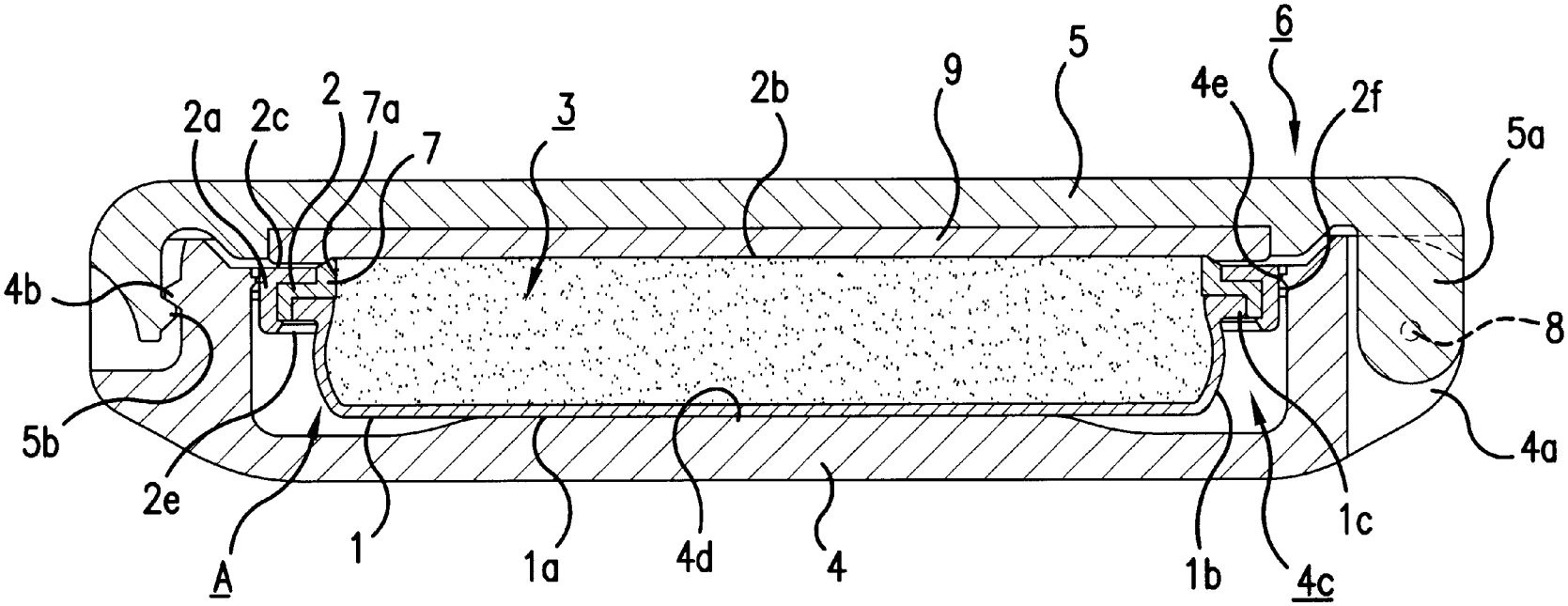
FIG. 3 is a side cross section view showing a cosmetic compact case in which a refillable container is assembled to an outer container, according to the first embodiment of the invention.
Figure 4:
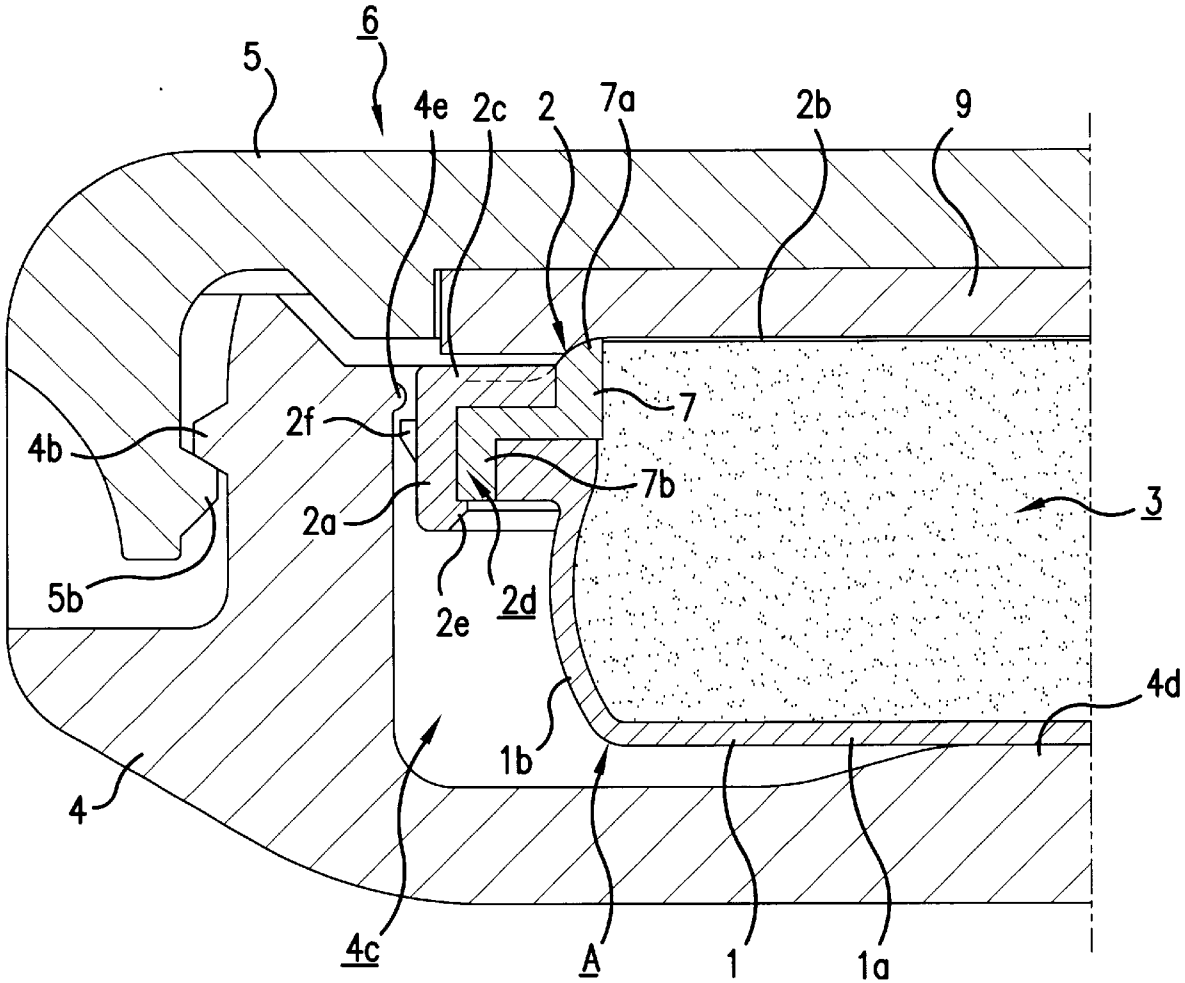
FIG. 4 is an enlarged cross section view showing the relationship between a refillable container and a packing, according to the first embodiment of the invention.
Figure 5:
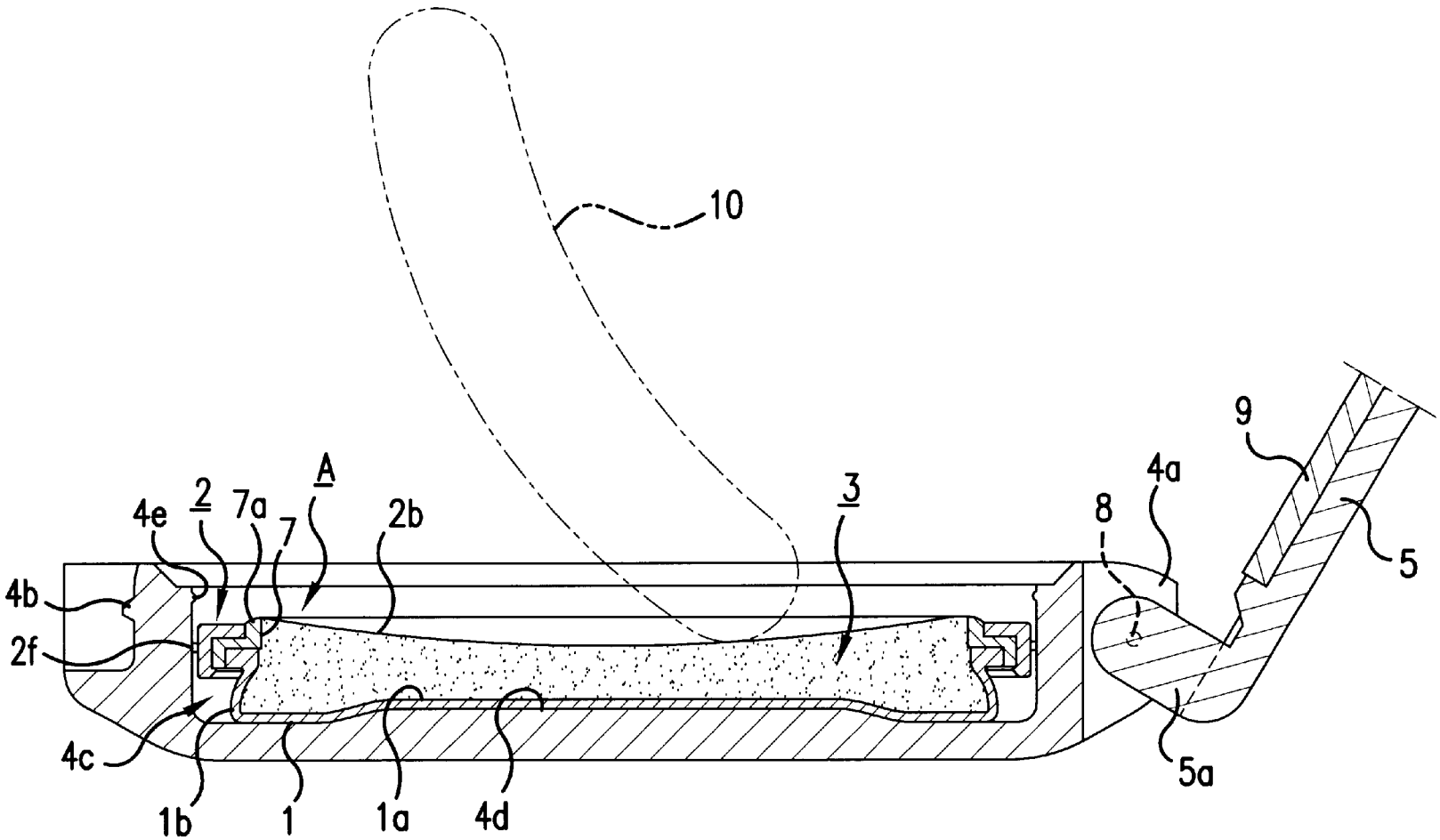
FIG. 5 is a side cross section view showing the state of a refillable container when it is used, according to the first embodiment of the invention.

Hereinafter the first embodiment of the netted refillable container is described along with the following drawings. FIG. 1 is a perspective view showing a refillable container in a partially dissected state. FIGS. 2*a* and 2*b* are enlarged cross section views showing a container body and a net frame of the refillable container. FIG. 3 is a side cross section view showing a cosmetic compact case in which a refillable container is assembled to an outer container. FIG. 4 is an enlarged cross section view showing the relationship between a refillable container and a packing. FIG. 5 is a cross section view showing the state of a refillable container when it is used.

The refillable container A shown in FIG. 1 is comprised of a container body land a net frame 2 in a state where a powdery cosmetic material 3 is contained inside the container body 1, and as shown in FIG. 3 the refillable container is attached to a cosmetic compact case 6 having an outer container 4 and a lid 5, and when the contained powdery cosmetic material 3 is used up, the refillable container is detached from the outer container 4 and disposed.

The container body 1 is a dish-shaped container molded from a flexible synthetic resin material, e.g., elastomer based material such as urethane or the like, having a bottom panel 1*a* whose inner surface is substantially flat, a side panel 1*b* extending upright from the peripheral rim of the bottom panel and curving outward to form the shape of a greater than sign ("<"), an opening rim 1*c* formed at the top end of the side panel 1*b* in which the opening rim defines the edge of an opening 1*d*. Therefore, with thus container body 1, when a downward force from the upper portion, that is, a downward force from the opening 1*d* is applied, the bottom panel 1*a* makes contact to a projection 4*d* of the outer container 4 and creates a bending along the bottom panel 1*a* and the side panel 1*b*; in accordance to this bending the contained powdery cosmetic material 3 is forced outward.

By using a rigid synthetic resin material e.g., ABS resin, and by using a molding method such as the double molding method, a ring 7 is molded in a united body along the top surface and the peripheral surface of the opening rim 1*c*. This ring 7 includes a projecting ring-shaped rib 7*a* of a prescribed height located on the top-end surface and a cover 7*b* sheathing the peripheral opening rim 1*c* of the container body 1. Although there is no specification regarding the position of the rib 7*a* of ring 7, it is preferable to make the inner surrounding surface of the rib 7*a* face the opening 1*d* of the container body 1 by forming the rib 7*a* at the inner surrounding of the ring 7. Thus structured, the opening 1*d* and the inner surrounding surface of rib 7*a* fit closely to each other, thereby, a space which may otherwise cause the accumulation of the powdery cosmetic material will not be created.

Therefore, having the opening rim 1*c* as a border, the bottom panel 1*a* and the side panel 1*b* formed at the lower portion of the container body bear flexibility, whereas, the upper portion of the container body 1 comprising the ring 7 bears rigidity. Furthermore, the opening 1*d* surrounded by the side panel 1*b* of the container body is protected by the ring 7 (rib 7*a*).

The net frame 2 is comprised of an engagement loop 2*a* serving as a frame body and having the shape corresponding to that of the ring 7 surrounding the opening 1*d* on the upper portion of the container body 1, and a netting 2*b* having a predetermined mesh stretching across the inner side of the engagement loop 2*a*. This net frame 2 is manufactured by an insertion-molding method integrating the net frame 2 with the engagement loop 2*a* wherein a netting 2*b* cut into a shape of a circle is placed inside a metallic mold beforehand during the injection molding of the engagement loop 2*a*. In this process, since the netting 2*b* is placed inside the metallic mold in a free manner, as shown in FIG. 2, after the net frame 2 has been molded, the netting 2*b* becomes slightly loose which is different compared to a tension effected stretched out state The net frame 2 is attached to the container body 1 in a manner in which the net frame 2 surrounds the entire upper portion of the container body 1 including the ring 7. That is, the engagement loop 2*a* of the net frame 2 has an inner diameter slightly larger than the outer diameter of the rib 7*a* formed at the ring 7. Furthermore, the engagement loop 2*a* of the net frame has a flange portion 2*c* thinner than the height of the rib 7*a*, wherein the netting 2*b* is stretched along the inner surface of the flange portion 2*c*. The engagement loop 2*a* has a thickness substantially equal to that of cover 7*b* of ring 7 and has a recess 2*d* with an inner diameter substantially equal to the outer diameter of cover 7*b*, and furthermore, formed at the tip of the recess 2*d* is a hook 2*c*. A number of engagement projections 2*f* are formed on the prescribed positions of the peripheral surface of engagement loop 2*a*.

Therefore, as shown in FIG. 1, when the net frame 2 is attached to container body 1, the netting 2*b* comprised in the net frame 2 is pushed upwards as a whole by the rib 7*a* of the ring 7 and positioned higher than the top surface of the flange portion 2*c*. In accordance to the tension caused by the upward pushing force, the netting becomes sufficiently high-strung and stretched out. That is, even if there was to be a looseness created at the netting 2*b*, this looseness can be eliminated.

The engagement loop 2*a* contains the ring 7 in the recess 2*d*, and the hook 2*e* extends along the peripheral surface of the cover 7*b* and engages to the bottom end of the engagement loop 2*a*. In thus state, since the ring 7 is molded from a rigid synthetic resin material, a firm attaching state can be maintained without deformation even if the hook 2*e* is engaged to the bottom end of the engagement loop 2*a*.

In respect of the foregoing refillable container A, the upper portion bears a moderate solidness owing to the rigidity of the ring 7; in correspondence to the height of the rib 7*a*, the netting 2*b* projects higher than the flange portion 2*c* of engagement loop 2*a*. On the other hand, the bottom portion bears a moderate softness owing to the flexibility of the container body 1.

The refillable container A thus structured is contained in the outer container 4 of the cosmetic compact case 6. The cosmetic compact case 6 is comprised with an outer container 4 and an openably and closably attached lid 5. That is, on one end of the outer container 4 and the lid 5, the hinge member 4*a* and the hinge member 5*a* are formed respectively, and on the other end, the engagement projection 4*b* and the engagement projection 5*b* are formed respectively. By rotatably attaching the hinge member 4*a* to the hinge member 5*a* through the use of the axis member 8, the refillable container A can be opened and closed, and by engaging the engagement projection 4*b* and the engagement projection 5*b*, the refillable container A can maintain the state of being closed.

In means to contain the refillable container A, the outer container 4 is formed with a containing portion 4*c* having the dimension capable of containing the refillable container A. Formed at the bottom panel of the containing portion 4*c* is a projection 4*d* making contact with the bottom panel 1*a* of the container body 1 in which the projection 4*d* has a square area smaller than that of the bottom panel 1*a*. Furthermore, an engagement projection 4*e* is formed at the inner peripheral surface of the containing portion 4*c* in which the engagement projection 4*e* engages to the engagement projection 2*f* formed at the outer peripheral surface of the engagement loop 2*a* of the net frame 2.

Accordingly, in the state where the cosmetic compact case is open, attachment is accomplished by inserting the refillable container A into the containing portion 4*c* of the outer container 4, and then by fixing the refillable container A to the containing portion 4*c* with applying pressure from the upper portion of the engagement ring 2*a* of the net frame 2, and at the same time, by engaging the engagement projection 4*f* with the engagement projection 4*f* formed at the inner peripheral surface of the containing portion 4*c*. On the other hand, when the powdery cosmetic material 3 contained inside the container body 1 is used up, the refillable container A can easily be detached from the cosmetic compact case 6 by deforming the ring 7 and the net frame 2 of the refillable container A.

The packing 9 is attached to the inner surface of the lid 5. This packing 9 is comprised of a moderately elastic sheet-like member, and is positioned facing the rib 7*a* of the refillable container A attached to the containing portion 4*c* of the outer container 4, and is formed having the measurements larger than that of the plane of the rib 7. The thickness of the packing 9 is predetermined to a certain measurement so that the packing 9 can sufficiently press against the rib 7*a* (netting 2*b*) of the refillable container A contained in the outer container 4.

Therefore, when the refillable container A contained in the cosmetic compact case 6 is closed, the netting 2*b* of the refillable container A makes contact to substantially the entire surface of the packing 9 provided at the inner surface of the lid 5 and the rib 7 makes contact to the foregoing packing 9 as well. In thus state, the packing 9 presses against the rib 7*a* and the netting 2*b* without creating any gap, and enables the opening 1*d* of the refillable container A to be hermetically sealed, and also, prevents the spillage of the contained powdery cosmetic material 3.

Next, the usage of the thus structured cosmetic compact case 6 is described as follows. As shown in FIG. 3 and FIG. 4, when the cosmetic compact case 6 is stored or carried, the lid 5 is closed upon the outer container 4. In thus state, the netting 2*b* and the rib 7*a* of the refillable container A makes contact to the packing 9 attached to the inner surface of the lid 5, and in accordance with this contact, the packing 9 deforms and furthermore, due to the reactionary force, the refillable container A slightly descends and causes the engagement projection 4*e* and the corresponding engagement projection 2*f* to become disengaged.

In the foregoing state, the rib 7*a* is pressed against the packing 9 and in accordance with this pressing force the entire surface of.the netting 2*b* is pressed against the packing 9. More particularly, even if the pressing force from the packing 9 works upon the rib 7*a*, the rib 7*a* will not deform from such force because the rib 7*a* is formed from a rigid synthetic resin material. Therefore, even when used for a long period, it becomes possible to maintain the pressured contacting state between the netting 9 and the packing 9 and furthermore, no space between the components will be created.

Consequently, the powdery cosmetic material 3 contained in the container body 1 will not pass through the netting 2*b* and will not spill between the packing 9 and the netting 2*b*, and furthermore, the powdery cosmetic material 3 will not scatter when the lid 5 is opened.

In using the cosmetic compact case 6, as shown in FIG. 5, the lid 5 is opened and exposes the netting 2*b*. Then by rubbing a cosmetic tool 10, e.g., powder puff, sponge against the top surface of the netting 2*b*, the powdery cosmetic material 3 sticks to the cosmetic tool 10.

In thus state, especially when the powdery cosmetic material 3 contained in the container body 1 becomes scarce, due to the force created when the cosmetic tool 10 is rubbed against the netting 2*b*, the bottom panel 1*a* of the container body 1 makes contact to the projection 4*d* of the outer container 4 in which movement becomes restricted, and a bending is created along the portions not making contact to the projection 4*d*, that is, along the bottom panel 1*a* and the side panel 1*b*. Consequently, the netting 2*b* and the bottom panel 1*a* (the portion corresponding to the projection 4*d*) move toward each other, in which the powdery cosmetic material 3 contained in the container body 1 seeps through the netting 2*b*, therefore, enabling the powdery cosmetic material 3 to stick to the cosmetic tool 10 for further use.

Furthermore, whenever the cosmetic compact case 6 is used, a bending is created along the bottom panel 1*a* and the side panel 1*b* of the container body 1 and in accordance to this bending, the powdery cosmetic material 3 contained in the container body 1 fluidly slides and enables the prevention of the solidification of the powdery contained material 3.

As described above in detail, with the refillable container according to this invention, due to the rib provided at the periphery of the opening of the container body, the netting built along the net frame becomes projected, and thereby, when the cosmetic compact case is closed, the packing provided at the inner surface of the lid is pressed against the rib and at the same time, the netting clings to the entire surface of the packing. More particularly, since the rib is molded from a rigid synthetic resin material, deformation will not occur through the passing of time and the pressing force of the rib against the packing will not cause deformation even when used for a long period of time. Therefore, the spillage of the powdery cosmetic material contained inside the container body can be prevented.

Furthermore, since the rib bears rigidity, during the attachment of the net frame to the container body, the rib applies tension to the netting and enables the netting to project; accordingly, even if a looseness is created along the netting during the molding of the net frame, this looseness can be eliminated.

As described above, since the rib has more rigidity and projects higher than the flange portion of the net frame, the rib can firmly press against the packing when the lid is closed. Therefore, even if the size precision of the rib is not so high, the pressing state against the packing can be maintained. Furthermore, when the net frame is attached, a tension is applied to the netting and enables the netting to stretch out. Therefore, the pressing state against the packing of the netting can be obtained, even without maintaining a high molding precision.

Since the container body deforms due to the force applied to the refillable container during use, the contained powdery cosmetic material fluidly slides in accordance with this deformation and the solidification of the powdery contained material can be prevented.

Second Embodiment

Figure 6:
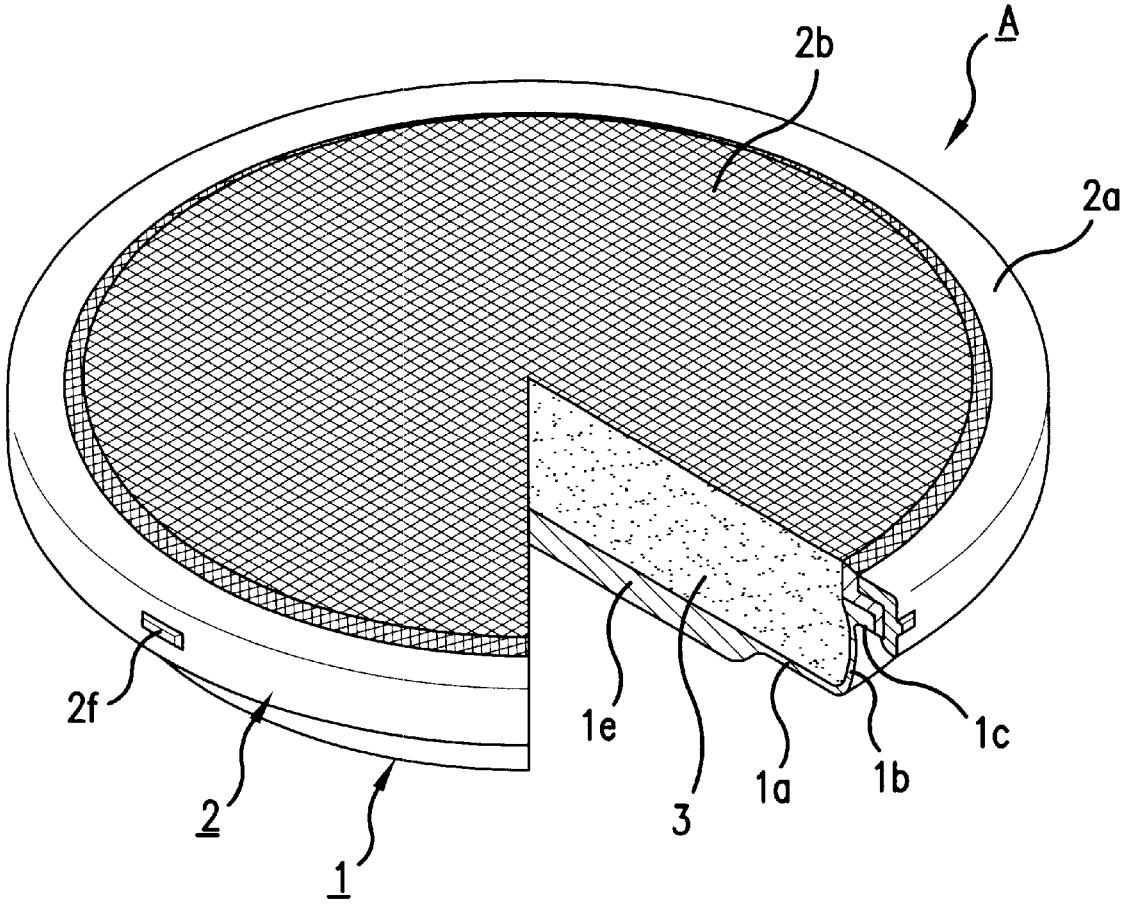
FIG. 6 is a perspective view showing a refillable container, partially dissected, according to the second embodiment of the invention.
Figure 7A:
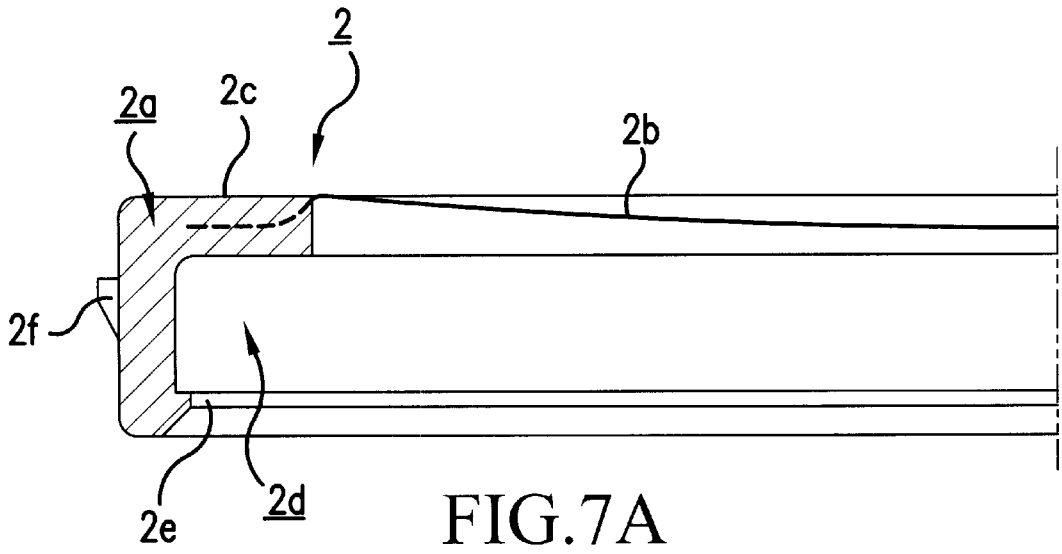
FIGS. 7*a* and 7*b* are enlarged cross section views showing a container body and a net frame of a refillable container, according to the second embodiment of the invention.
Figure 7B:
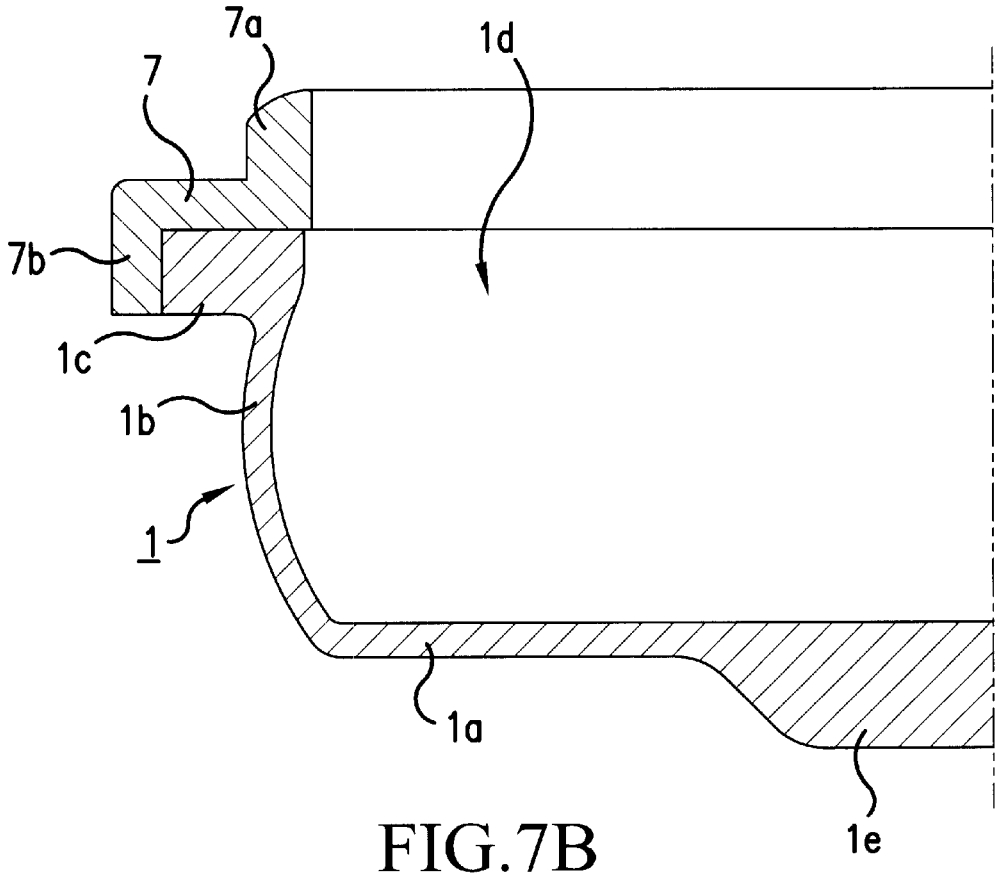
Figure 8:
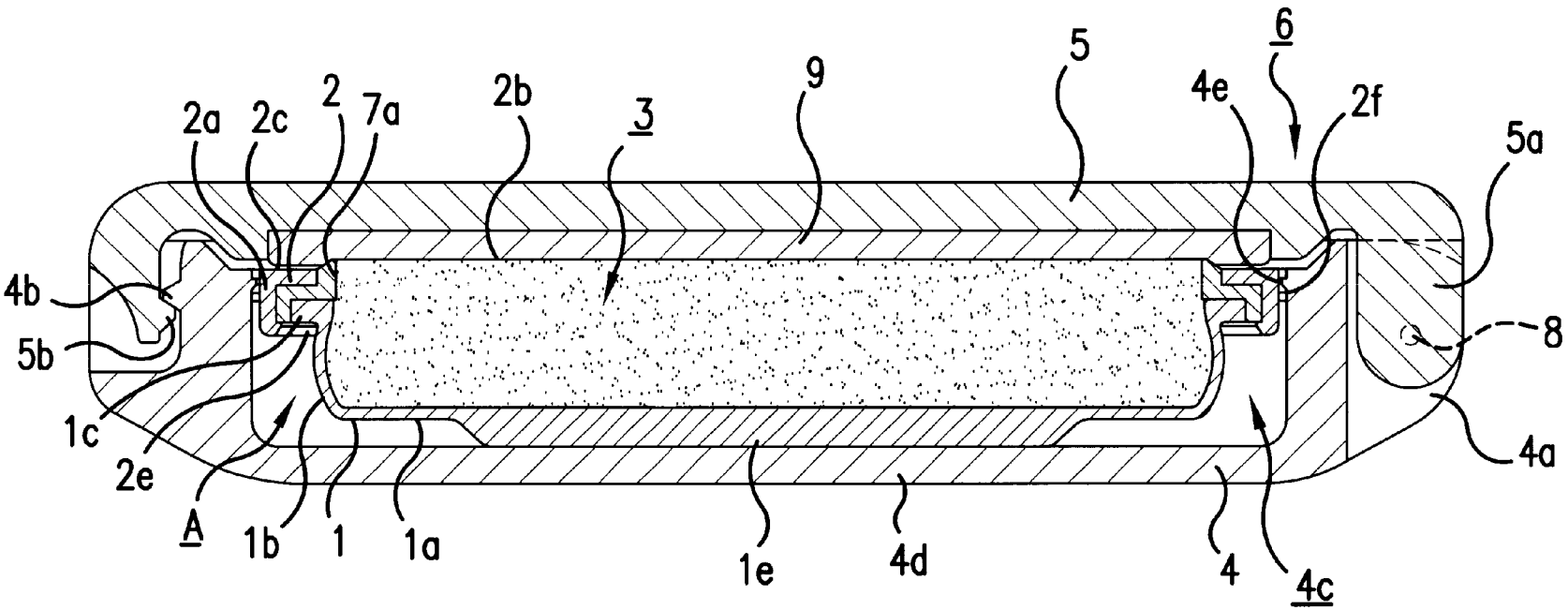
FIG. 8 is a side cross section view showing a cosmetic compact case in which a refillable container is assembled to an outer container, according to the second embodiment of the invention.
Figure 9:
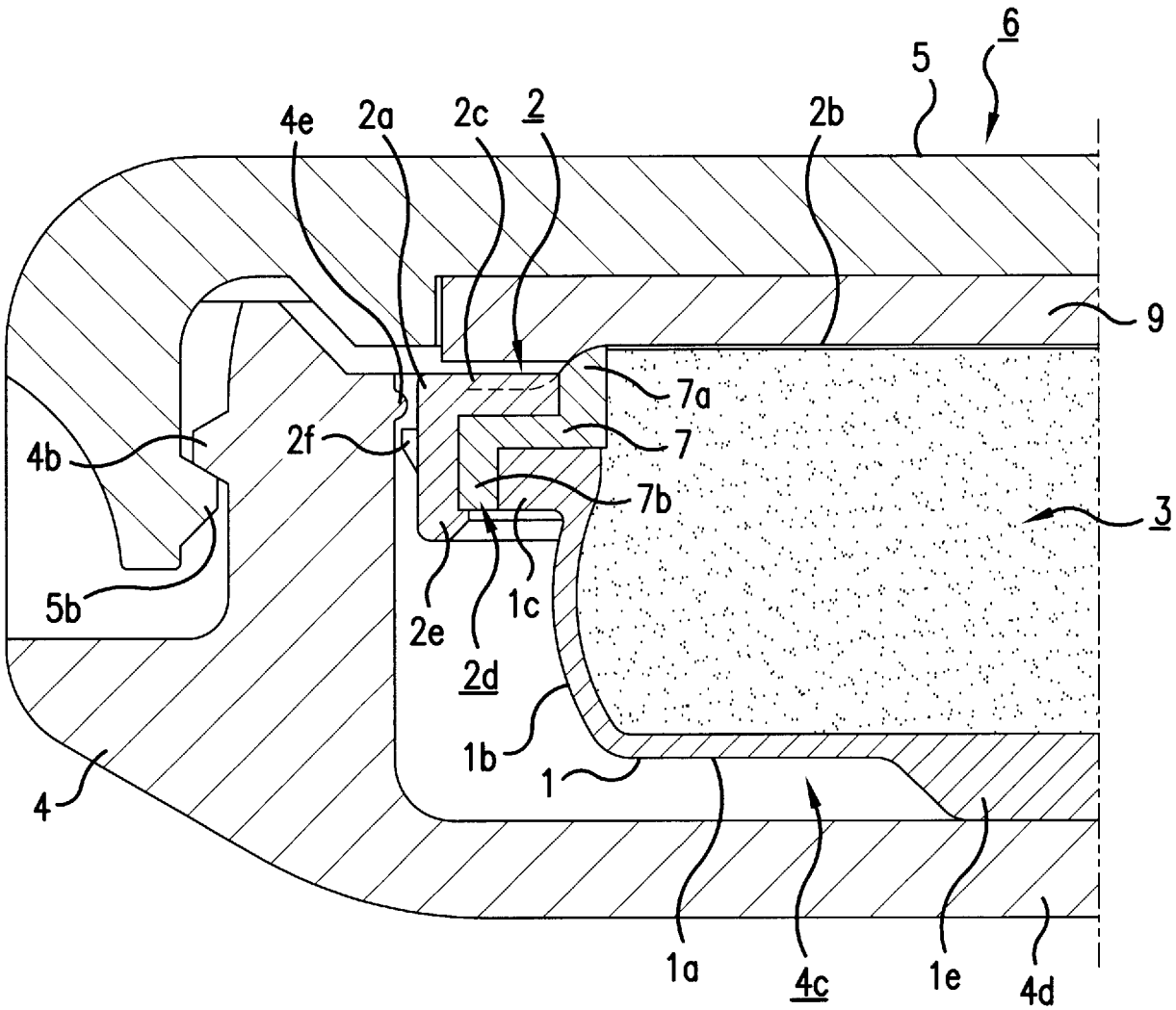
FIG. 9 is an enlarged cross section view showing the relationship between a refillable container and a packing, according to the second embodiment of the invention.
Figure 10:
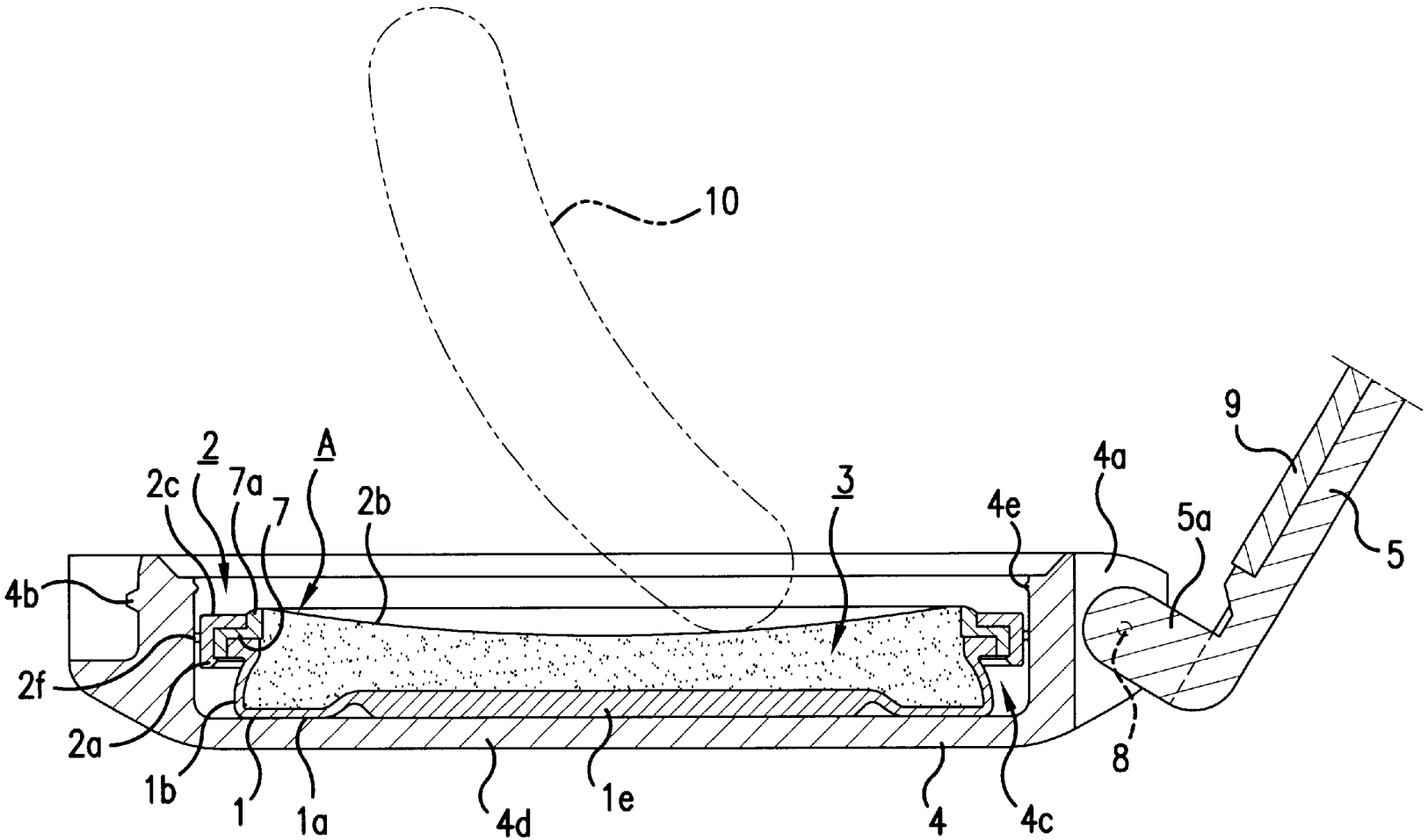
FIG. 10 is a side cross section view showing the state of a refillable container when it is used, according to the second embodiment of the invention.

Referring to FIG. 6 to FIG. 10, the second embodiment of the netted refillable container according to the invention is described below. FIG. 6 is a perspective view showing a refillable container in a partially dissected state. FIGS. 7*a* and 7*b* are enlarged cross section views showing a container body and a net frame of the refillable container. FIG. 8 is a side cross section view showing a cosmetic compact case in which a refillable container is assembled to an outer container. FIG. 9 is an enlarged cross section view showing the relationship between a refillable container and a packing. FIG. 10 is a side cross section view showing the state of a refillable container when it is used.

The refillable container A shown in FIG. 6 is comprised of a container body 21 and a net frame 22 in a state where a powdery cosmetic material 23 is contained inside the container body 21, and as shown in FIG. 8 the refillable container is attached to a cosmetic compact case 26 having an outer container 24 and a lid 25, and when the contained powdery cosmetic material 23 is used up, the refillable container is detached from the outer container 24 and disposed.

The container body 21 is a dish-shaped container molded from a flexible synthetic resin material, e.g., elastomer based material such as urethane or the like, having a bottom panel 21*a* whose inner surface is substantially flat, a side panel 21*b* extending upright from the peripheral rim of the bottom panel and curving outward to form the shape of a greater-than sign ("<"), an opening rim 21*c* formed at the top end of the side panel 21*b* in which the opening rim defines the edge of an opening 21*d*.

According to the second embodiment, when effected and moved by a downward force from the container body 21 contained in the outer container 24 (force from the upper portion of the opening directed towards the bottom panel 21*a*), the projection 21*e* provided at the outer surface of the bottom panel 21*a* is functioned to make contact to the bottom panel of the outer container 24 and restrict the movement of the bottom panel 1 which allows the deformation of the container body 21. Therefore, the projection 21*e* is positioned substantially at the center on the outer surface of the bottom panel 21*a* of the container body 21.

With thus container body 21, when a downward force from the upper portion, that is, a downward force from the opening 21*d* is applied, the projection 21*e* makes contact to a projection 24*d* of the outer container 24 and a bending is created along the bottom panel 21*a* and the side panel 21*b*; in accordance to this bending the contained powdery cosmetic material 23 is forced outward.

By using a rigid synthetic resin material e.g., ABS resin, and by using a molding method such as the double molding method, a ring 27 is molded in a united body along the top surface and the peripheral surface of the opening rim 21*c*. This ring 27 includes a projecting ring-shaped rib 27*a* of a prescribed height located on the top-end surface and a cover 27*b* sheathing the peripheral opening rim 21*c* of the container body 21. Although there is no specification regarding the position of the rib 27*a* of ring 27, it is preferable to make the inner surrounding surface of the rib 27*a* face the opening 21*d* of the container body 21 by forming the rib 27*a* at the inner surrounding of the ring 27. Thus structured, the opening 21*d* and the inner surrounding surface of rib 27*a* fit closely to each other, thereby, a space which may otherwise cause the accumulation of the powdery cosmetic material will not be created.

Therefore, having the opening rim 21*c* as a border, the bottom panel 21*a* and the side panel 21*b* formed at the lower portion of the container body 21 bear flexibility, whereas, the upper portion of the container body 21 comprising the ring 27 bears rigidity. Furthermore, the opening 21*d* surrounded by the side panel 21*b* of the container body is protected by the ring 27 (rib 27*a*).

The net frame 22 is comprised of an engagement loop 22*a* serving as a frame body and having the shape corresponding to that of the ring 27 surrounding the opening 21*d* on the upper portion of the container body 21 and a netting 22*b* having a predetermined mesh stretching across the inner side of the engagement loop 22*a*. This net frame 22 is manufactured by an insertion-molding method integrating the net frame 22 with the engagement loop 22*a* wherein a netting 22*b* cut into a shape of a circle is placed inside a metallic mold beforehand during the injection molding of the engagement loop 22*a*. In this process, since the netting 22*b* is placed inside the metallic mold in a free manner, as shown in FIG. 7, the netting 22*b* becomes slightly loose after the net frame 22 has been molded which is different compared to a tension effected stretched out state The net frame 22 is attached to the container body 21 in a manner in which the net frame surrounds the entire upper portion of the container body 21 including the ring 27. That is, the engagement loop 22*a* of the net frame 22 has an inner diameter slightly larger than the outer diameter of the rib 27*a* formed at the ring 27. Furthermore, the engagement loop 22*a* of the net frame has a flange portion 22*c* thinner than the height of the rib 27*a*, wherein the netting 22*b* is stretched along the inner surface of the flange portion 22*c*. The engagement loop 22*a* has a thickness substantially equal to that of cover 27*b* of ring 27 and has a recess 22*d* with an inner diameter substantially equal to the outer diameter of cover 27*b*, and furthermore, formed at the tip of the recess 22*d* is a hook 22*c*. A number of engagement projections 22*f* are formed on the prescribed positions of the peripheral surface of engagement loop 22*a*.

Therefore, as shown in FIG. 6, when the net frame 22 is attached to container body 21, the netting 22*b* comprised in the net frame 22 is pushed upwards as a whole by the rib 27*a* of the ring 27 and positioned higher than the top surface of the flange portion 22*c*. In consequence to the tension caused by the upward pushing force, the netting becomes adequately high-strung and stretched out. That is, even if there was to be a looseness created at the netting 22*b*, this looseness can be eliminated.

The engagement loop 22*a* contains the ring 27 in the recess 22*d*, and the hook 22*e* extends along the peripheral surface of the cover 27*b* and engages to the bottom end of the engagement loop 22*a*. In thus state, since the ring 27 is molded from a rigid synthetic resin material, a firm attaching state can be maintained without deformation even if the hook 22*e* is engaged to the bottom end of the engagement loop 22*a*.

Regarding the foregoing refillable container 2A, the upper portion bears a moderate rigidity and corresponding to the height of the rib 27*a*, the netting 22*b* projects higher than the flange portion 22*c* of engagement loop 22. On the other hand, the bottom portion bears a moderate flexibility due to the flexibility of the container body 21.

The refillable container 20A thus structured is contained in the outer container 24 of the cosmetic compact case 26. Cosmetic compact case 26 is comprised with an outer container 24 and an openably and closably attached lid 25. That is, on one end of the outer container 24 and the lid 25, the hinge member 24*a* and the hinge member 25*a* are formed respectively, and on the other end, the engagement projection 24*b* and the engagement projection 25*b* are formed respectively. By rotatably attaching the hinge member 24*a* to the hinge member 25*a* through the use of the axis member 28, the refillable container 20A can be opened and closed, and by engaging the engagement projection 24*b* and the engagement projection 25*b*, the refillable container 20A can maintain the state of being closed.

In means to contain the refillable container 20A, the outer container 24 is built with a containing portion 24*c* having the dimension capable of containing the refillable container 20A. The bottom panel 24*d* of the containing portion 24*c* has a substantially flat surface, and furthermore, an engagement projection 24*e* is formed at the inner peripheral surface of the containing portion 24*c* in which the engagement projection 24*e* engages to the engagement projection 22*f* formed at the outer peripheral surface of the engagement loop 22*a* of the net frame 22.

In the state where the cosmetic compact case is open, attachment is accomplished by inserting the refillable container 20A into the containing portion 24*c* of the outer container 24, and then by fixing the refillable container 20A to the containing portion 24*c* through the use of pressure from the upper portion of the engagement ring 22*a* of the net frame 22, and at the same time, by engaging the engagement projection 24*f* with the engagement projection 24*f* formed at the inner peripheral surface of the containing portion. When the powdery cosmetic material 23 contained inside the container body 21 is used up, the refillable container 20A can easily be detached from the cosmetic compact case 26 by deforming the ring 27 and the net frame 22 of the refillable container 20A.

The packing 29 is attached to the inner surface of the lid 25. This packing 29 is comprised of a moderately elastic sheet-like member, and is positioned facing the rib 27*a* of the refillable container 20A attached to the containing portion 24*c* of the outer container 24, and is formed having the measurements larger than that of the plane of the rib 27. The thickness of the packing 29 is predetermined to a certain measurement so that the packing 29 can sufficiently press against the rib 27*a* (netting 22*b*) of the refillable container 20A contained in the outer container 24.

Therefore, when the refillable container 20A contained in the cosmetic compact case 26 is closed, the netting 22*b* of the refillable container 20A makes contact to substantially the entire surface of the packing 29 provided at the inner surface of the lid 25 and the rib 27 makes contact to the foregoing packing 29 as well. In thus state, the packing 29 presses against the rib 27*a* and the netting 22*b* without creating any gap, and enables the opening 21*d* of the refillable container 20A to be hermetically sealed, and also, prevents the spillage of the contained powdery cosmetic material 23.

The usage of the thus structured cosmetic compact case 26 is described next. As shown in FIG. 8 and FIG. 9, when the cosmetic compact case 26 is stored or carried, the lid 25 is closed upon the outer container 24. In this state, the netting 22*b* and the rib 27*a* of the refillable container 20A makes contact to the packing 29 attached to the inner surface of the lid 25, and in accordance with this contact, the packing 29 deforms and furthermore, due to the reactionary force, the refillable container 20A slightly descends and also the engagement projection 24*e* and the corresponding engagement projection 22*f* becomes disengaged.

In the foregoing state, the rib 27*a* is pressed against the packing 29 and in accordance to this pressing force the entire surface of the netting 22*b* is pressed against the packing 29. More particularly, even if the pressing force from the packing 29 works upon the rib 27*a*, the rib 27*a* will not deform from such force because the rib 27*a* is formed from a rigid synthetic resin material. Therefore, even when used for a long period, it becomes possible to maintain the pressured state between the netting 29 and the packing 29 and furthermore, no space between the components will be created.

Consequently, the powdery cosmetic material 23 contained in the container body 21 will not pass through the netting 22*b* and will not spill between the packing 29 and the netting 22*b*, and furthermore, the powdery cosmetic material 23 will not scatter when the lid 25 is opened.

In using the cosmetic compact case 26, as shown in FIG. 10, the lid 25 is opened and exposes the netting 22*b*. Then by rubbing a cosmetic tool 30, e.g., powder puff, sponge against the top surface of the netting 22*b*, the powdery cosmetic material 23 sticks to the cosmetic tool 30.

In thus state, especially when the powdery cosmetic material 23 contained in the container body 21 becomes scarce, due to the force created when the cosmetic tool 30 is rubbed against the netting 22*b*, the projection 21*e* provided at the outer surface of the bottom panel 21*a* of the container body makes contact to the projection 24*d* of the outer container 24 in which movement becomes restricted, and at the same time, a bending is created along the surrounding of the projection 21*e* provided at the bottom panel 21*a* and the side panel 21*b*. Consequently, the netting 22*b* and the bottom panel 21*a* (the portion corresponding to the projection 24*d*) move toward each other, in which the powdery cosmetic material 23 contained in the container body 21 seeps through the netting 22*b*, therefore, enabling the powdery cosmetic material 23 to stick to the cosmetic tool 30 for further use.

Furthermore, whenever the cosmetic compact case 26 is used, a bending is created along the bottom panel 21*a* and the side panel 21*b* of the container body 21 and in accordance to this bending, the powdery cosmetic material 23 contained in the container body 21 fluidly slides and enables the prevention of the solidification of the powdery cosmetic material 23.

As described above, with the refillable container according to this invention, due to the rib provided at the periphery of the opening of the container body, the netting built along the net frame becomes projected, and thereby, when the cosmetic compact case is closed, the packing provided at the inner surface of the lid is pressed against the rib and at the same time, the netting clings to the entire surface of the packing. More particularly, since the rib is molded from a rigid synthetic resin material, deformation will not occur through the passing of time and the pressing force of the rib against the packing will not cause deformation even when used for a long period of time. Therefore, the spillage of the powdery cosmetic material contained inside the container body can be prevented.

Since the rib bears rigidity, during the attachment of the net frame to the container body, the rib applies tension to the,netting and enables the netting to project; accordingly, even if a looseness is created along the netting during the molding of the net frame, this looseness can be eliminated.

As described above, since the rib has more rigidity and projects higher than the flange portion of the net frame, the rib can firmly press against the packing when the lid is closed. Therefore, even if size precision of the rib is not so high, the pressing state against the packing can be maintained. Furthermore, when the net frame is attached, a tension is applied to the netting and enables the netting to stretch out. Therefore, the pressing state against the packing of the netting can be obtained, even without maintaining a molding of high precision.

Since the container body deforms due to the force applied to the refillable container during use, the contained powdery cosmetic material fluidly slides in accordance with this deformation and the solidification of the powdery cosmetic material can be prevented.

Third Embodiment

Figure 11:
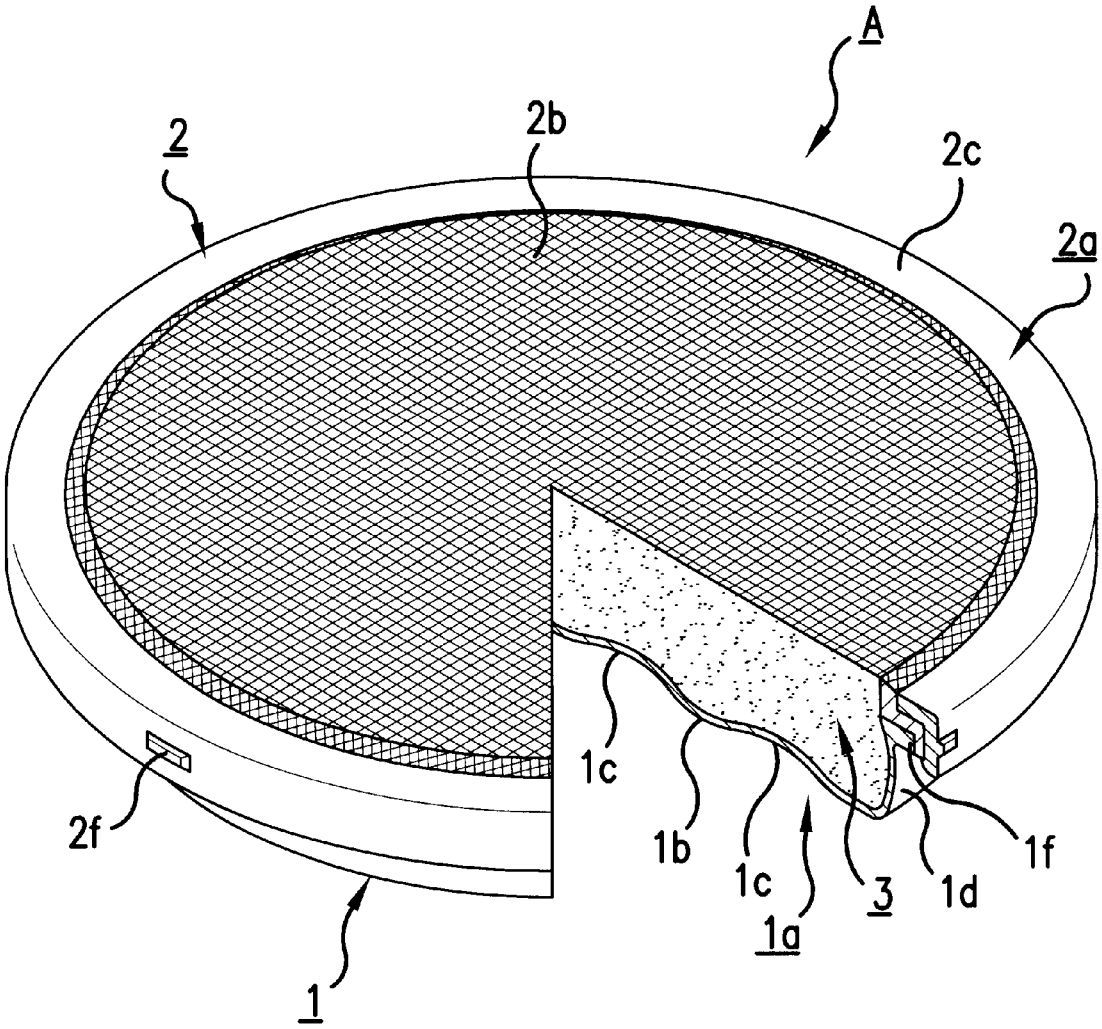
FIG. 11 is a perspective view showing a refillable container, partially dissected, according to the third embodiment of the invention.
Figure 12A:
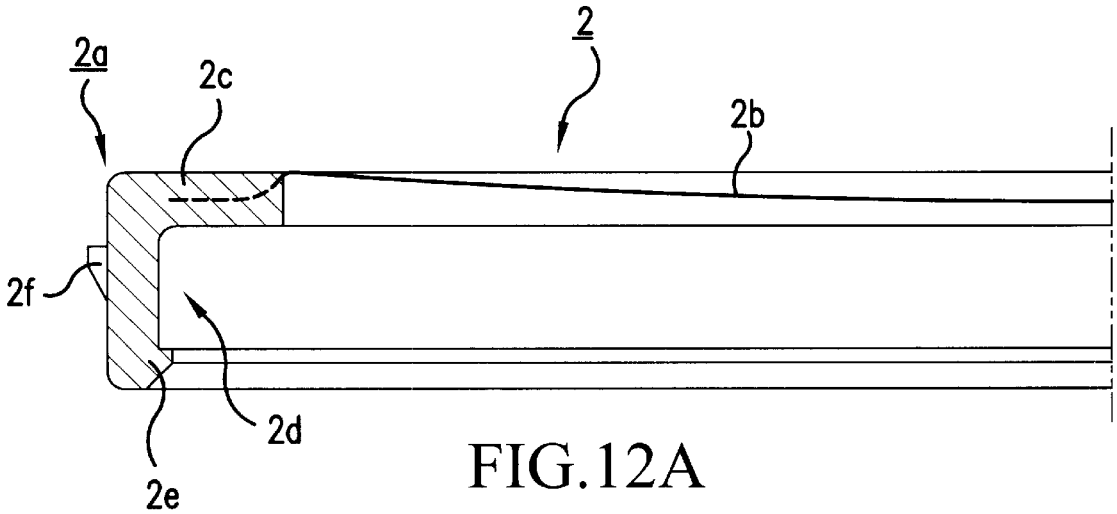
FIGS. 12*a* and 12*b* are enlarged cross section views showing a container body and a net frame of a refillable container, according to the third embodiment of the invention.
Figure 12B:
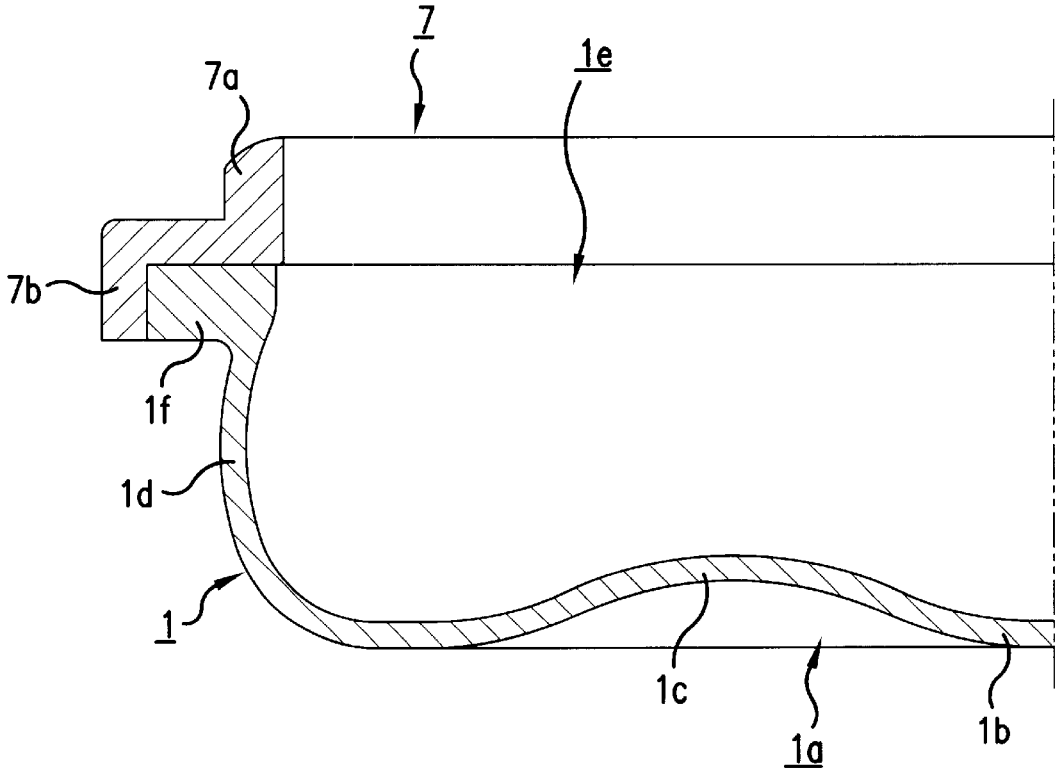
Figure 13:
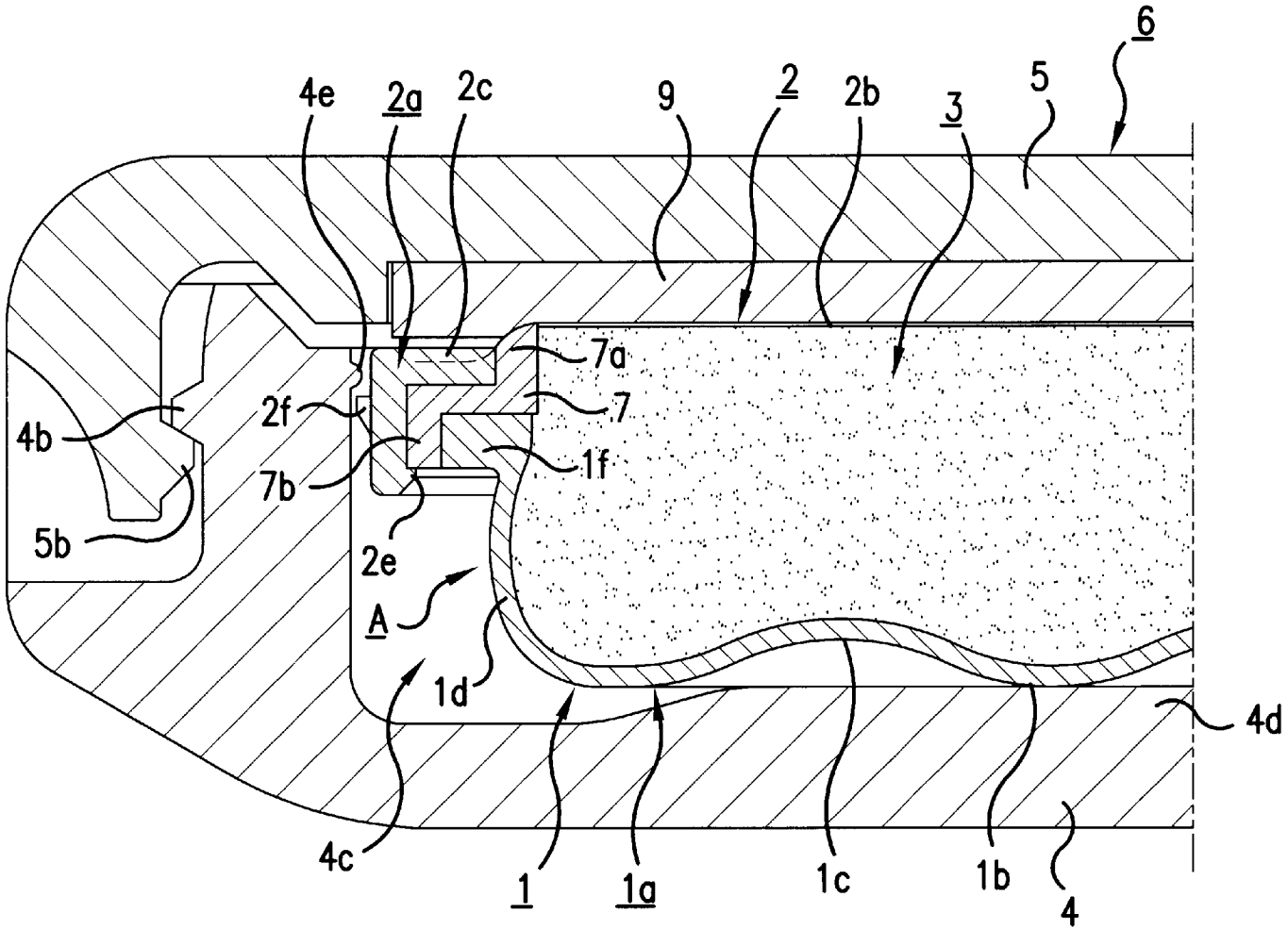
FIG. 13 is a side cross section view showing a cosmetic compact case in which a refillable container is assembled to an outer container, according to the third embodiment of the invention.
Figure 14:
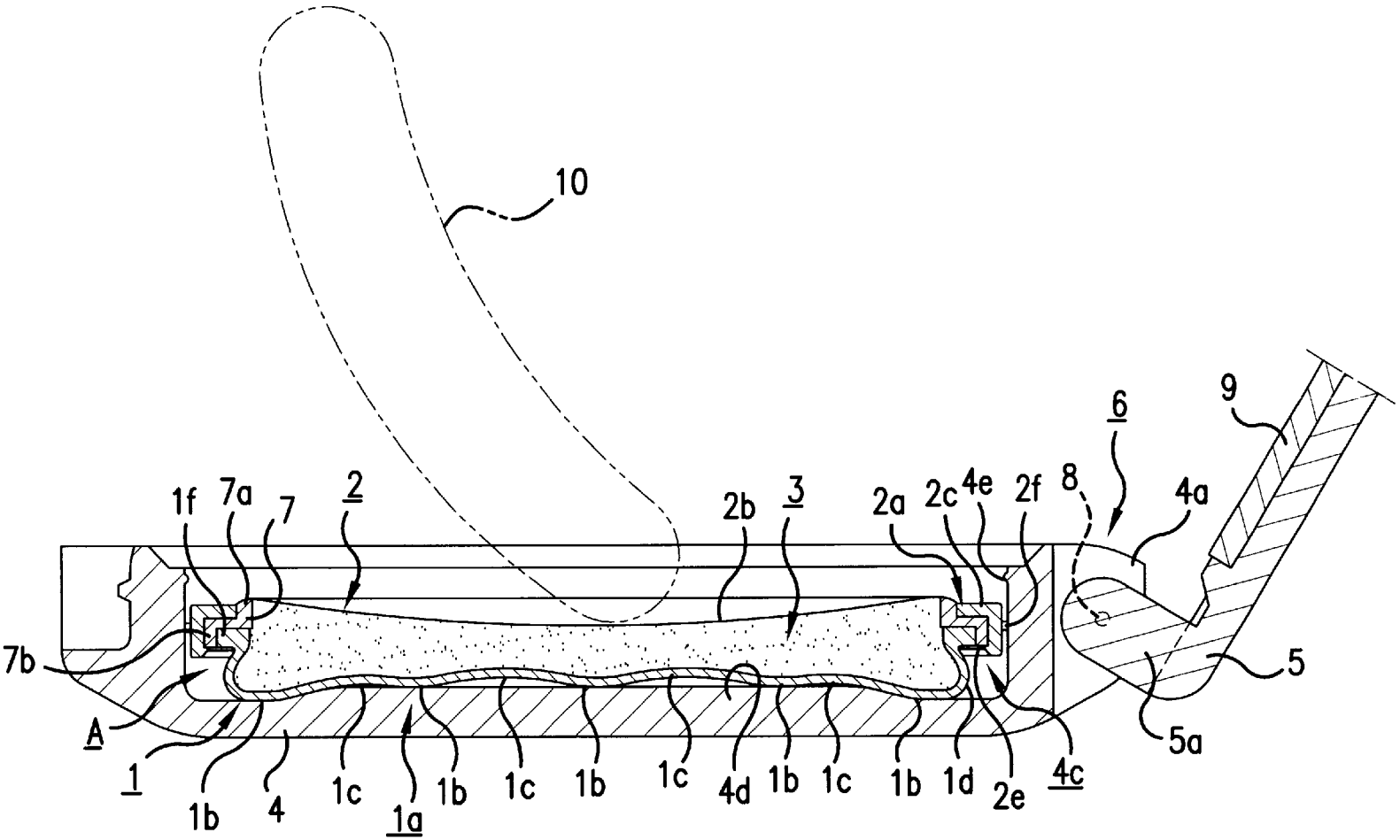
FIG. 14 is a side cross section view showing the state of a refillable container when it is used, according to the third embodiment of the invention.
Figure 15:
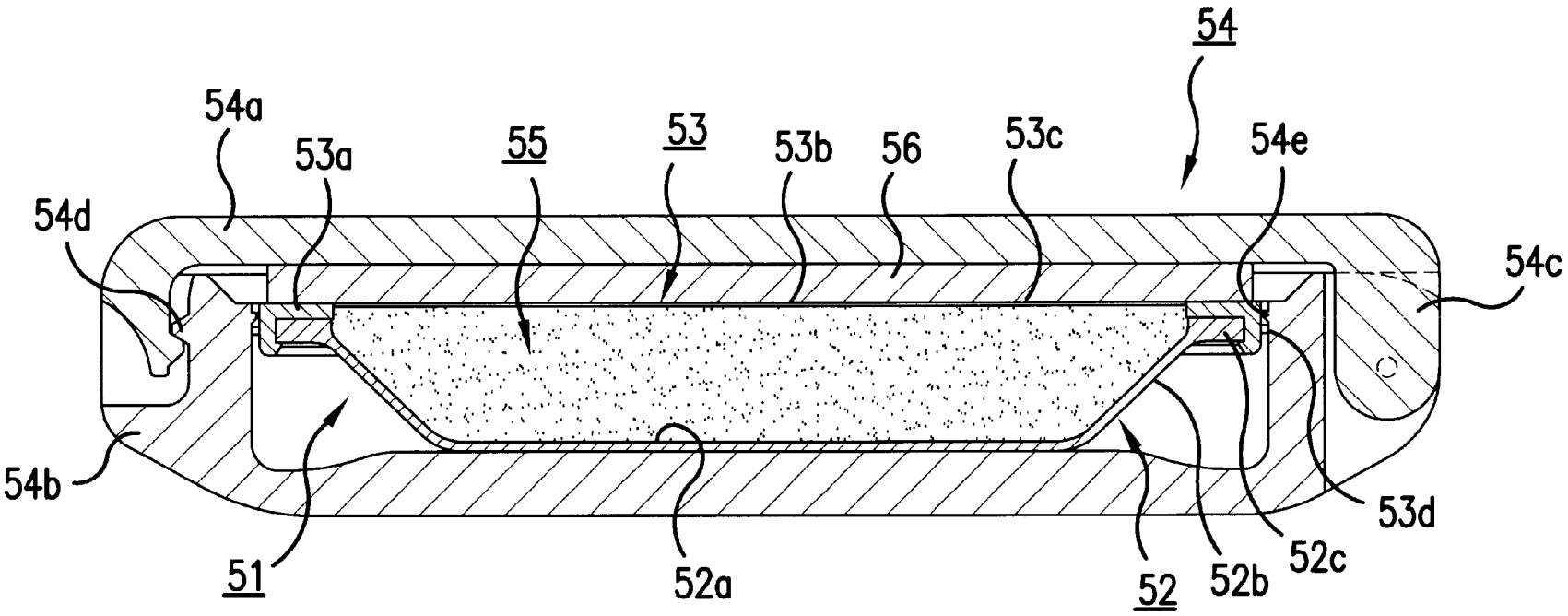
FIG.15 (Prior Art)
FIG. 15 is a side cross section view showing a conventional cosmetic compact case comprising a refillable container.

Referring to FIG. 11 to FIG. 14, the third embodiment of the netted refillable container according to the invention is described below. FIG. 11 is a perspective view showing a refillable container in a partially dissected state. FIGS. 12*a* and 12*b* are enlarged cross section views showing a container body and a net frame of a refillable container. FIG. 13 is a side cross section view showing a cosmetic compact case in which a refillable container is assembled to an outer container. FIG. 14 is a side cross section showing the state of the refillable container when used.

The refillable container A shown in FIG. 11 is comprised of a container body 41 and a net frame 42 in a state where a powdery cosmetic material 43 is contained inside the container body 41, and as shown in FIG. 13 the refillable container is attached to a cosmetic compact case 46 having an outer container 44 and a lid 45, and when the contained powdery cosmetic material 43 is used up, the refillable container is detached from the outer container 44 and disposed.

The container body 41 is a dish-shaped container molded from a flexible synthetic resin material, e.g., elastomer based material such as urethane or the like, having a bottom panel 41*a* having a corrugated cross section in which the projections 41*b* formed in an outwardly convex shape and the recesses 41*c* formed in a concave shape curving from the outside toward the inside are formed in an alternative manner, a side panel 41*d* extending upright from the peripheral rim of the bottom panel and curving outward to form the shape of a greater-than sign ("<"), an opening rim 41*f* formed at the top end of the side panel 41*d* in which the opening rim defines the edge of an opening 41*e*.

A plurality of the projections 41*b* and the recesses 41*c* is formed at the cross section of the bottom panel 41*a*; by forming these projections 41*b* and recesses 41*c* in a continuous manner, a corrugated shape is formed. It is preferable for these projections 41*b* and the recesses 41*c* to be formed into a similar to the plane shape of the container body 41 (the outer shape of the bottom panel 41*a*). For example, when the plane shape of the container body 41 is a circle, the projection 41*b* and the recess 41*c* would alternately form into that of a concentric circle. There are no specifications regarding the height (measurements) between the projection 41*b* and the recess 41*c*.

By forming the bottom panel 41*a* of the container body 41 into a corrugation with the projection 41*b* and the recess 41*c* formed continuously, it becomes easier for the bottom panel 41*a* to deform across the entire surface and in accordance with the deformation of the side panel 41*d*, it becomes possible for the powdery cosmetic material 43 contained inside the container body 41 to flow whenever in use.

Therefore, in respect of the foregoing container body 41, when a downward force from the upper portion, that is, a downward force from the opening 41*e* is applied, in accordance with thus force, after the projection 41*b* of bottom panel 41*a* makes contact to the projection 44*d* provided on the bottom panel of the outer container 44, movement becomes restricted and a bending is created along the projection 41*b* and the recess 41*c* of the bottom panel 41*a* and also along the side panel 41*d*.

By using a rigid synthetic resin material e.g., ABS resin, and by using a molding method such as the double molding method, a ring 47 is molded in a united body along the top surface and the peripheral surface of the opening rim 41*c*. This ring 47 includes a projecting ring-shaped rib 47*a* of a prescribed height located on the top-end surface and a cover 47*b* sheathing the peripheral opening rim 41*c* of the container body 41. Although there is no specification regarding the position of the rib 47*a* of ring 47, it is preferable to make the inner surrounding surface of the rib 47*a* face the opening 41*d* of the container body 41 by forming the rib 47*a* at the inner surrounding of the ring 47. Thus structured, the opening 41*d* and the inner surrounding surface of rib 47*a* fit closely to each other, thereby, a space which may otherwise cause the accumulation of the powdery cosmetic material will not be created.

Therefore, having the opening rim 41*c* as a border, the bottom panel 41*a* and the side panel 41*b* formed at the lower portion of the container body bear flexibility, whereas, the upper portion of the container body. 41 comprising the ring 47 bears rigidity. Furthermore, the opening 41*d* surrounded by the side panel 41*b* of the container body is protected by the ring 47 (rib 47*a*).

The net frame 42 is comprised of an engagement loop 42*a* serving as a frame body and having the shape corresponding to that of the ring 47 surrounding the opening 41*d* on the upper portion of the container body 41 and a netting 42*b* having a predetermined mesh stretching across the inner side of the engagement loop 42*a*. This net frame 42 is manufactured by an insertion-molding method integrating the net frame 42 with the engagement loop 42*a* wherein a netting 42*b* cut into a shape of a circle is placed inside a metallic mold beforehand during the injection molding of the engagement loop 42*a*. In this process, since the netting 42*b* is placed inside the metallic mold in a free manner, as shown in FIG. 12, the netting 42*b* becomes slightly loose after the net frame 42 has been molded which is different compared to a tension effected stretched out state The net frame 42 is attached to the container body 41 in a manner in which the net frame surrounds the entire upper portion of the container body 41 including the ring 47. That is, the engagement loop 42*a* of the net frame 42 has an inner diameter slightly larger than the outer diameter of the rib 47*a* formed at the ring 47. Furthermore, the engagement loop 42*a* of the net frame has a flange portion 42*c* thinner than the height of the rib 47*a*, wherein the netting 42*b* is stretched along the inner surface of the flange portion 42*c*. The engagement loop 42*a* has a thickness substantially equal to that of cover 47*b* of ring 447 and has a recess 42*d* with an inner diameter substantially equal to the outer diameter of cover 47*b*, and furthermore, formed at the tip of the recess 42*d* is a hook 42*c*. A number of engagement projections 42*f* are formed on the prescribed positions of the peripheral surface of engagement loop 42*a*.

Therefore, as shown in FIG. 11, when the net frame 42 is attached to container body 41, the netting 42*b* comprised in the net frame 42 is pushed upwards as a whole by the rib 47*a* of the ring 47 and positioned higher than the top surface of the flange portion 42*c*. In consequence to the tension caused by the upward pushing force, the netting becomes adequately high-strung and stretched out. That is, even if there was to be a looseness created at the netting 42*b*, this looseness can be eliminated.

The engagement loop 42*a* contains the ring 47 in the recess 42*d*, and the hook 42*e* extends along the peripheral surface of the cover 47*b* and engages to the bottom end of the engagement loop 42*a*. In thus state, since the ring 47 is molded from a rigid synthetic resin material, a firm attaching state can be maintained without deformation even if the hook 42*e* is engaged to the bottom end of the engagement loop 42*a*.

Regarding the foregoing refillable container 40A, the upper portion bears a moderate solidness owing to the rigidity of the ring 47 and in correspondence to the height of the rib 47*a* the netting 42*b* projects higher than the flange portion 42*c* of engagement loop 42. On the other hand, the bottom portion bears a moderate softness owing to the flexibility of the container body 41.

The refillable container 40A thus structured is contained in the outer container 44 of the cosmetic compact case 46. Cosmetic compact case 46 is comprised with an outer container 44 and an openably and closably attached lid 45. That is, on one end of the outer container 44 and the lid 45, the hinge member 44*a* and the hinge member 45*a* are formed respectively, and on the other end, the engagement projection 44*b* and the engagement projection 45*b* are formed respectively. By rotatably attaching the hinge member 44*a* to the hinge member 45*a* through the use of the axis member 48, the refillable container 40A can be opened and closed, and by engaging the engagement projection 44*b* and the engagement projection 45*b*, the refillable container 40A can maintain the state of being closed.

In means to contain the refillable container 40A, the outer container 44 is built with a containing portion 44*c* having the dimension capable of containing the refillable container 40A. Formed at the bottom surface of the containing portion 44*c* is a projection 44*d* making contact to the bottom panel 41*a* of the container body 41 and furthermore, an engagement projection 44*e* is formed at the inner peripheral surface of the containing portion 44*c* in which the engagement projection 44*e* engages to the engagement projection 42*f* formed at the outer peripheral surface of the engagement loop 42*a* of the net frame 42.

In the state where the cosmetic compact case is open, attachment is accomplished by inserting the refillable container 40A into the containing portion 44*c* of the outer container 44, and then by fixing the refillable container 40A to the containing portion 44*c* through the use of pressure from the upper portion of the engagement ring 42*a* of the net frame 42, and at the same time, by engaging the engagement projection 44*f* with the engagement projection 44*f* formed at the inner peripheral surface of the containing portion. When the powdery cosmetic material 43 contained inside the container body 41 is used up, the refillable container 40A can easily be detached from the cosmetic compact case 46 by deforming the ring 47 and the net frame 42 of the refillable container 40A.

The packing 49 is attached to the inner surface of the lid 45. This packing 49 is comprised of a moderately elastic sheet-like member, and is positioned facing the rib 47*a* of the refillable container 40A attached to the containing portion 44*c* of the outer container 44, and is formed having the measurements larger than that of the plane of the rib 47. The thickness of the packing 49 is predetermined to a certain measurement so that the packing 49 can sufficiently press against the rib 47*a* (netting 42*b*) of the refillable container 40A contained in the outer container 44.

Therefore, when the refillable container 40A contained in the cosmetic compact case 46 is closed, the netting 42*b* of the refillable container 40A makes contact to substantially the entire surface of the packing 49 provided at the inner surface of the lid 45 and the rib 47 makes contact to the foregoing packing 49 as well. In thus state, the packing 49 presses against the rib 47*a* and the netting 42*b* without creating any gap, and enables the opening 41*d* of the refillable container 40A to be hermetically sealed, and also, prevents the spillage of the contained powdery cosmetic material 43.

The usage of the thus structured cosmetic compact case 46 is described as follows. As shown in FIG. 13, when the cosmetic compact case 46 is stored or carried, the lid 45 is closed upon the outer container 44. In thus state, the netting 42*b* and the rib 47*a* of the refillable container 40A makes contact to the packing 49 attached to the inner surface of the lid 45, and in accordance with this contact, the packing 49 deforms and furthermore, due to the reactionary force, the refillable container 40A slightly descends and also the engagement projection 44*e* and the corresponding engagement projection 42*f* becomes disengaged.

In the foregoing state, the rib 47*a* is pressed against the packing 49 and in accordance to this pressing force the entire surface of the netting 42*b* is pressed against the packing 49. More particularly, even if the pressing force from the packing 49 works upon the rib 47*a*, the rib 47*a* will not deform from such force because the rib 47*a* is formed from a rigid synthetic resin material. Therefore, even when used for a long period, it becomes possible to maintain the pressured state between the netting 49 and the packing 49 and furthermore, no space between the components will be created.

Consequently, the powdery cosmetic material 43 contained in the container body 41 will not pass through the netting 42*b* and will not spill between the packing 49 and the netting 42*b*, and furthermore, the powdery cosmetic material 43 will not scatter when the lid 45 is opened.

In using the cosmetic compact case 46, as shown in FIG. 14, the lid 45 is opened and exposes the netting 42*b*. Then by rubbing a cosmetic tool 50, e.g., powder puff, sponge against the top surface of the netting 42*b*, the powdery cosmetic material 43 sticks to the cosmetic tool 50.

Due to the force created when the cosmetic tool 50 is rubbed against the netting 42*b*, the bottom panel 41*a* of the container body 41 makes contact to the projection 44*d* of the outer container 44. In thus state, the projection 41*b* of the bottom panel 41*a* makes contact to the projection 44*d* provided on the bottom panel of the outer container 44 in which movement becomes restricted, and a bending is created along the projection 41*b* and the recess 41*c* and also along the side panel 41*b*. Consequently, the netting 42*b* and the bottom panel 41*a* move toward each other, in which the powdery container material 43 contained in the container body 41 seeps through the netting 42*b*, therefore, enabling the powdery container material 43 to stick to the cosmetic tool 50 for further use.

The above mentioned bending is created along the bottom panel 41*a* and the side panel 41*d* of the container body 41 whenever the cosmetic compact case 46 is used, and in accordance with this bending, the powdery cosmetic material 43 contained in the container body 41 is caused to flow. The foregoing flow of the powdery cosmetic material 43 inside the container body 41 enables the prevention of the solidification of the powdery contained material 43.

As described above, with the refillable container according to this invention, because the cross section of the bottom panel of the container body is formed into a corrugation, the bottom panel moves towards the bottom panel of the outer container and the projection makes contact to the bottom panel in accordance with the downward force from the upper portion. Thus is followed by the deformation along the projection and the recess at the bottom panel; which then causes the entire bottom panel to deform owing to the continuous applying of force. Therefore, the flowing of the powdery cosmetic material can be obtained and accordingly, the solidification of the powdery cosmetic material can be prevented.

Furthermore, due to the rib provided at the periphery of the opening of the container body, the netting built along the net frame becomes projected, and thereby, when the cosmetic compact case is closed, the packing provided at the inner surface of the lid is pressed against the rib and at the same time, the netting clings to the entire surface of the packing. More particularly, since the rib is molded from a rigid synthetic resin material, deformation will not occur through the passing of time and the pressing force of the rib against the packing will not cause deformation even when used for a long period of time. Therefore, the spillage of the powdery cosmetic material contained inside the container body can be prevented.

Since the rib bears rigidity, during the attachment of the net frame to the container body, the rib applies tension to the netting which enables the netting to project; accordingly, even if a looseness is created along the netting during the molding of the net frame, this looseness can be eliminated.

As described above, since the rib has more rigidity and projects higher than the flange portion of the net frame, the rib can firmly press against the packing when the lid is closed. Therefore, even if the measurements of the rib is not of high precision, the pressing state against the packing can be maintained. Furthermore, when the net frame is attached, a tension is applied to the netting which enables the netting to stretch out. Therefore, the pressing state against the packing of the netting can be obtained, even without maintaining a high molding precision.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but should be defined claims set forth below.

What is claimed is:

1. A netted refillable container comprising:

a container body molded of a flexible synthetic resin material for containing a powdery cosmetic material therein, the container body having:

a substantially flat bottom panel;

a side panel extending upright from the bottom panel, the side panel curving outward or inward;

an opening surrounded by the side panel; and a ring molded as a united body from a rigid synthetic resin surrounding the opening bearing a convex rib on the top end of the ring, and a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body; and when the container body is contained in a recess of an outer container having the recess of a prescribed depth and a projection on the bottom panel, the bottom panel of the container body faces the projection, and when a lid openably attached to the outer container in bearing a packing facing the convex rib of the container body is closed, the convex rib of the container body presses against the packing through the netting of the net frame.

2. A netted refillable container comprising:

a container body molded from a flexible synthetic resin material for containing a powdery cosmetic material, the container body having:

a bottom panel having a substantially flat inner surface and an outer surface provided with a projection at a prescribed position;

a side panel extending upright from the bottom panel, the side panel curving outward or inward;

an opening surrounded by the side panel; and a ring molded as a united body from a rigid synthetic resin surrounding the opening bearing a convex rib on the top end of the ring; and a net frame having a netting insert-molded to the inner surface of an annular frame body, the netting covering the opening of the container body and engaging the convex rib, the annular frame body engaging to the container body;

wherein the netting is pushed upward by the convex rib to a position higher than the top surface of the net frame when the net frame is fitted to the container body; and when the container body is contained in a recess of an outer container having the recess of a prescribed depth and a bottom panel, the projection provided at the outer surface of the bottom panel of the container body faces the bottom panel of an outer container, and when a lid openably attached to the outer container in bearing a packing facing the convex rib of the container body is closed, the convex rib of the container body presses against the packing through the netting of the net frame.

3. A netted refillable container comprising:

a container body molded from a flexible synthetic resin material for containing a powdery cosmetic material, the container body having:

a bottom panel having a corrugated cross-section;

a side panel extending upright from the bottom panel, the side panel curving outward or inward;

an opening surrounded by the side panel; and a ring molded as a united body from a rigid synthetic resin surrounding the opening bearing a convex rib on the top end of the ring; and a net frame having a netting insert-molded to the inner surface of an annular frame body, the netting covering the opening of the container body and engaging the convex rib, the annular frame body engaging to the container body, wherein the netting is pushed upward by the convex rib to a position higher than the top surface of the net frame when the net frame is fitted to the container body; and when the container body is contained in a recess of an outer container having the recess of a prescribed depth and a projection on the bottom panel, the corrugated bottom panel of the container body faces the projection, and when a lid openably attached to the outer container in bearing a packing facing the convex rib of the container body is closed, the convex rib of the container body presses against the packing through the netting of the net frame.

* * * * *